US011213093B2

(12) United States Patent
Wardlaw et al.

(10) Patent No.: US 11,213,093 B2
(45) **Date of Patent: *Jan. 4, 2022**

(54) CUSHIONING ELEMENT FOR SPORTS APPAREL

(71) Applicant: adidas AG, Herzogenaurach (DE)

(72) Inventors: Angus Wardlaw, Nuremberg (DE); Stuart David Reinhardt, Nuremberg (DE); Christopher Edward Holmes, Veitsbronn (DE); Tru Huu Minh Le, Erlangen (DE)

(73) Assignee: adidas AG, Herzogenaurach (DE)

( * ) Notice: Subject to any disclaimer, the term of this patent is extended or adjusted under 35 U.S.C. 154(b) by 194 days.

This patent is subject to a terminal disclaimer.

(21) Appl. No.: 16/680,852

(22) Filed: Nov. 12, 2019

(65) Prior Publication Data

US 2020/0113280 A1 Apr. 16, 2020

Related U.S. Application Data

(60) Continuation of application No. 15/703,031, filed on Sep. 13, 2017, now Pat. No. 10,506,846, which is a (Continued)

(30) Foreign Application Priority Data

Feb. 13, 2013 (DE) ..... 102013202291.3
Jan. 28, 2014 (EP) ..... 14152906

(51) Int. Cl.
*A43B 13/18* (2006.01)
*A43B 7/06* (2006.01)
(Continued)

(52) U.S. Cl.
CPC ..... *A43B 13/187* (2013.01); *A43B 3/0042* (2013.01); *A43B 7/06* (2013.01); *A43B 13/04* (2013.01); *A43B 17/14* (2013.01)

(58) Field of Classification Search
CPC ..... A43B 13/187; A43B 13/04; A43B 13/122; A43B 13/125; A43B 7/06; A43B 7/087; A43B 17/14
See application file for complete search history.

(56) References Cited

U.S. PATENT DOCUMENTS

D64,898 S 6/1924 Gunlock
2,131,756 A 10/1938 Roberts
(Continued)

FOREIGN PATENT DOCUMENTS

CN 1034662 8/1989
CN 1036128 10/1989
(Continued)

OTHER PUBLICATIONS

Office Action, Chinese Patent Application No. 201810071758.2, dated Mar. 5, 2021, 16 pages.
(Continued)

*Primary Examiner* — Ted Kavanaugh
(74) *Attorney, Agent, or Firm* — Kilpatrick Townsend & Stockton LLP

(57) ABSTRACT

Improved cushioning elements for sports apparel, in particular for soles for sports shoes, are described. A cushioning element for sports apparel with a first deformation element is provided. The deformation element includes a plurality of randomly arranged particles of an expanded material, wherein there are first voids within the particles and/or between the particles.

18 Claims, 9 Drawing Sheets

Related U.S. Application Data division of application No. 14/178,720, filed on Feb. 12, 2014, now Pat. No. 9,781,970.

(51) Int. Cl.

| | |
|---|---|
| ***A43B 3/00*** | (2006.01) |
| ***A43B 13/04*** | (2006.01) |
| ***A43B 17/14*** | (2006.01) |

(56) References Cited

U.S. PATENT DOCUMENTS

| | | | |
|---|---|---|---|
| 2,968,106 | A | 1/1961 | Joiner et al. |
| 3,186,013 | A | 6/1965 | Glassman et al. |
| 3,264,381 | A | 8/1966 | Stevens |
| 3,452,390 | A | 7/1969 | Borcovec |
| 3,586,003 | A | 6/1971 | Baker |
| D237,323 | S | 10/1975 | Inohara |
| 3,953,558 | A | 4/1976 | Hatano et al. |
| 4,132,016 | A | 1/1979 | Vaccari |
| 4,364,189 | A | 12/1982 | Bates |
| 4,424,180 | A | 1/1984 | Lalloz et al. |
| 4,481,727 | A | 11/1984 | Stubblefield et al. |
| 4,524,529 | A | 6/1985 | Schaefer |
| 4,546,559 | A | 10/1985 | Dassler et al. |
| 4,624,062 | A | 11/1986 | Autry |
| 4,642,911 | A | 2/1987 | Talarico et al. |
| 4,658,515 | A | 4/1987 | Oatman et al. |
| 4,667,423 | A | 5/1987 | Autry et al. |
| D296,262 | S | 6/1988 | Brown et al. |
| 4,754,561 | A | 7/1988 | Dufour et al. |
| D302,898 | S | 8/1989 | Greenberg |
| RE33,066 | E | 9/1989 | Stubblefield |
| 4,864,739 | A | 9/1989 | Maestri et al. |
| 4,922,631 | A | 5/1990 | Anderie et al. |
| 4,928,739 | A | 5/1990 | Teubert |
| 4,970,807 | A | 11/1990 | Anderie et al. |
| 4,980,445 | A | 12/1990 | van Der wal et al. |
| 5,025,573 | A | 6/1991 | Giese et al. |
| D329,731 | S | 9/1992 | Adcock et al. |
| 5,150,490 | A | 9/1992 | Busch |
| D333,556 | S | 3/1993 | Purdom |
| D337,650 | S | 7/1993 | Thomas, III et al. |
| D340,797 | S | 11/1993 | Pallera et al. |
| 5,283,963 | A | 2/1994 | Lerner et al. |
| 5,308,420 | A | 5/1994 | Yang et al. |
| 5,319,866 | A | 6/1994 | Foley et al. |
| D350,016 | S | 8/1994 | Passke et al. |
| D350,222 | S | 9/1994 | Hase |
| 5,383,290 | A | 1/1995 | Grim |
| D356,438 | S | 3/1995 | Opie et al. |
| 5,549,743 | A | 8/1996 | Pearce |
| D375,619 | S | 11/1996 | Backus et al. |
| 5,617,650 | A | 4/1997 | Grim |
| 5,692,319 | A | 12/1997 | Parker et al. |
| 5,709,954 | A | 1/1998 | Lyden et al. |
| D389,991 | S | 2/1998 | Elliott |
| D390,349 | S | 2/1998 | Murai et al. |
| D393,340 | S | 4/1998 | Doxey |
| D395,337 | S | 6/1998 | Greene |
| D408,618 | S | 4/1999 | Wilborn et al. |
| D408,971 | S | 5/1999 | Birkenstock |
| D413,010 | S | 8/1999 | Birkenstock |
| D414,920 | S | 10/1999 | Cahill |
| D415,610 | S | 10/1999 | Cahill |
| D415,876 | S | 11/1999 | Cahill |
| 5,996,252 | A | 12/1999 | Cougar |
| 6,014,821 | A | 1/2000 | Yaw |
| 6,041,521 | A | 3/2000 | Wong |
| D422,400 | S | 4/2000 | Brady et al. |
| D423,199 | S | 4/2000 | Cahill |
| 6,108,943 | A | 8/2000 | Hudson et al. |
| D431,346 | S | 10/2000 | Birkenstock |
| D441,181 | S | 5/2001 | Morgan |
| D460,852 | S | 7/2002 | Daudier |
| 6,516,540 | B2 | 2/2003 | Seydel et al. |
| D482,855 | S | 12/2003 | Magro |
| 6,702,469 | B1 | 3/2004 | Taniguchi et al. |
| D490,222 | S | 5/2004 | Burg et al. |
| D490,230 | S | 5/2004 | Mervar |
| D490,233 | S | 5/2004 | Cooper |
| D492,099 | S | 6/2004 | McClaskie |
| 6,782,640 | B2 | 8/2004 | Westin et al. |
| 6,796,056 | B2 | 9/2004 | Swigart |
| D498,901 | S | 11/2004 | Hawker et al. |
| 6,821,465 | B1 | 11/2004 | Stein et al. |
| 6,925,734 | B1 | 8/2005 | Schaeffer et al. |
| 6,948,263 | B2 | 9/2005 | Covatch |
| 6,957,504 | B2 | 10/2005 | Morris |
| D511,617 | S | 11/2005 | Matis |
| D517,302 | S | 3/2006 | Ardissono |
| D538,518 | S | 3/2007 | Della Valle |
| 7,202,284 | B1 | 4/2007 | Limerkens et al. |
| D554,848 | S | 11/2007 | Marston |
| D555,343 | S | 11/2007 | Bettencourt |
| D555,345 | S | 11/2007 | Bettencourt |
| D560,883 | S | 2/2008 | McClaskie |
| D561,433 | S | 2/2008 | McClaskie |
| D561,438 | S | 2/2008 | Belley |
| D561,986 | S | 2/2008 | Horne et al. |
| D570,581 | S | 6/2008 | Moretti |
| D571,085 | S | 6/2008 | McClaskie |
| D572,462 | S | 7/2008 | Hatfield et al. |
| 7,421,805 | B2 | 9/2008 | Geer et al. |
| D586,090 | S | 2/2009 | Turner et al. |
| D589,690 | S | 4/2009 | Truelsen |
| D594,187 | S | 6/2009 | Hickman |
| D596,384 | S | 7/2009 | Andersen et al. |
| D601,333 | S | 10/2009 | McClaskie |
| D606,733 | S | 12/2009 | McClaskie |
| D607,190 | S | 1/2010 | McClaskie |
| D611,233 | S | 3/2010 | Della Valle et al. |
| 7,673,397 | B2 | 3/2010 | Jarvis |
| D616,183 | S | 5/2010 | Skaja |
| D617,540 | S | 6/2010 | McClaskie |
| D618,891 | S | 7/2010 | McClaskie |
| D631,646 | S | 2/2011 | Muller |
| D633,286 | S | 3/2011 | Skaja |
| D633,287 | S | 3/2011 | Skaja |
| D634,918 | S | 3/2011 | Katz et al. |
| D636,156 | S | 4/2011 | Della Valle et al. |
| D636,569 | S | 4/2011 | McMillan |
| D636,571 | S | 4/2011 | Avar |
| 7,941,941 | B2 | 5/2011 | Hazenberg et al. |
| D641,142 | S | 7/2011 | Lindseth et al. |
| D644,827 | S | 9/2011 | Lee |
| D645,649 | S | 9/2011 | McClaskie |
| D648,105 | S | 11/2011 | Schlageter et al. |
| D649,761 | S | 12/2011 | Chang |
| D649,768 | S | 12/2011 | Petrie |
| D650,159 | S | 12/2011 | Avar |
| 8,082,684 | B2 | 12/2011 | Munns |
| D655,488 | S | 3/2012 | Blakeslee |
| D659,364 | S | 5/2012 | Jolicoeur |
| 8,186,081 | B2 | 5/2012 | Wilson, III et al. |
| D671,723 | S | 12/2012 | Teteriatnikov |
| D680,725 | S | 4/2013 | Avar et al. |
| D680,726 | S | 4/2013 | Propét |
| D683,116 | S | 5/2013 | Petrie |
| 8,479,412 | B2 | 7/2013 | Peyton et al. |
| 8,490,297 | B2 | 7/2013 | Guerra |
| D693,553 | S | 11/2013 | McClaskie |
| D695,501 | S | 12/2013 | Yehudah |
| D698,137 | S | 1/2014 | Carr |
| D707,934 | S | 7/2014 | Petrie |
| D709,680 | S | 7/2014 | Herath |
| 8,834,770 | B2 | 9/2014 | Nakano et al. |
| D721,478 | S | 1/2015 | Avent et al. |
| 9,010,157 | B1 | 4/2015 | Podhajny et al. |
| D739,129 | S | 9/2015 | Del Biondi |
| D739,131 | S | 9/2015 | Del Biondi |
| D740,003 | S | 10/2015 | Herath |
| D740,004 | S | 10/2015 | Hoellmueller et al. |
| 9,212,270 | B2 | 12/2015 | Künkel et al. |
| D758,056 | S | 6/2016 | Herath et al. |

(56) References Cited

U.S. PATENT DOCUMENTS

D765,380 S 9/2016 Petrie
D776,410 S 1/2017 Herath et al.
D781,040 S 3/2017 Scofield
D783,264 S 4/2017 Hoellmueller et al.
9,610,746 B2 4/2017 Wardlaw et al.
D789,064 S 6/2017 Madore
D790,832 S 7/2017 Fogg
D796,813 S 9/2017 Link
D800,430 S 10/2017 Møller Hansen
9,781,970 B2 * 10/2017 Wardlaw ..... A43B 13/04
9,781,974 B2 10/2017 Reinhardt
9,788,598 B2 10/2017 Reinhardt
9,788,606 B2 10/2017 Reinhardt
9,820,528 B2 11/2017 Reinhardt et al.
9,849,645 B2 12/2017 Wardlaw et al.
9,930,928 B2 4/2018 Whiteman et al.
D819,942 S 6/2018 Cin et al.
D831,315 S 10/2018 Mahoney
D831,319 S 10/2018 Vasyli et al.
D850,766 S 6/2019 Girard et al.
D852,475 S 7/2019 Hoellmueller
D852,476 S 7/2019 Hartmann
D853,699 S 7/2019 Coonrod et al.
D855,953 S 8/2019 Girard et al.
D855,959 S 8/2019 Jenkins et al.
D856,648 S 8/2019 Small
D858,051 S 9/2019 Mace
D858,961 S 9/2019 Mace
D869,131 S 12/2019 Raasch
D869,833 S 12/2019 Hartmann et al.
D870,433 S 12/2019 Hartmann et al.
10,506,846 B2 * 12/2019 Wardlaw ..... A43B 13/187
D873,545 S 1/2020 Hartmann et al.
D874,098 S 2/2020 Hartmann et al.
D874,099 S 2/2020 Hartmann et al.
D874,107 S 2/2020 Girard et al.
D874,801 S 2/2020 Hartmann et al.
D875,358 S 2/2020 Vella
D875,359 S 2/2020 Dobson et al.
D875,360 S 2/2020 Vella
D875,361 S 2/2020 Girard et al.
D875,362 S 2/2020 Girard et al.
D876,055 S 2/2020 Hartmann et al.
D876,069 S 2/2020 Mace
D876,757 S 3/2020 Hartmann et al.
D876,775 S 3/2020 Petrenka
D876,791 S 3/2020 Gridley
D877,465 S 3/2020 Hartmann et al.
D877,466 S 3/2020 Hartmann et al.
D877,468 S 3/2020 Reyes
D878,015 S 3/2020 Hartmann et al.
D878,021 S 3/2020 Mace
D878,025 S 3/2020 Hartmann et al.
D879,424 S 3/2020 Hartmann et al.
D880,822 S 4/2020 Hartmann et al.
D882,222 S 4/2020 Garcia
D883,620 S 5/2020 Gridley
D883,621 S 5/2020 Garcia
D885,719 S 6/2020 Garcia
D885,721 S 6/2020 Williams
D885,722 S 6/2020 Le
D885,724 S 6/2020 Girard et al.
D887,112 S 6/2020 Mace
D887,113 S 6/2020 Girard et al.
2003/0131501 A1 7/2003 Erickson et al.
2003/0172548 A1 9/2003 Fuerst
2003/0208925 A1 11/2003 Pan
2003/0226280 A1 * 12/2003 Paratore ..... A43B 13/223 36/4
2004/0032042 A1 2/2004 Chi
2004/0053032 A1 3/2004 Weingartner
2004/0211088 A1 10/2004 Volkart
2005/0065270 A1 3/2005 Knoerr et al.
2005/0108898 A1 5/2005 Jeppesen et al.
2005/0113473 A1 5/2005 Wada
2005/0150132 A1 7/2005 Iannacone
2005/0241181 A1 11/2005 Cheng
2006/0010717 A1 1/2006 Finkelstein
2006/0026863 A1 * 2/2006 Liu ..... A43B 13/16 36/25 R
2006/0061000 A1 3/2006 Chun et al.
2006/0083912 A1 4/2006 Park et al.
2006/0100717 A1 5/2006 Abraham et al.
2006/0125134 A1 6/2006 Lin et al.
2006/0156579 A1 7/2006 Hoffer et al.
2006/0235095 A1 10/2006 Leberfinger et al.
2006/0283046 A1 12/2006 Mason
2007/0193070 A1 8/2007 Bertagna et al.
2007/0199213 A1 8/2007 Campbell et al.
2007/0295451 A1 12/2007 Willis
2008/0052965 A1 3/2008 Sato et al.
2008/0060221 A1 3/2008 Hottinger et al.
2008/0244932 A1 10/2008 Nau et al.
2008/0250666 A1 10/2008 Votolato
2009/0013558 A1 1/2009 Hazenberg et al.
2009/0025260 A1 1/2009 Nakano
2009/0113758 A1 5/2009 Nishiwaki et al.
2009/0119023 A1 5/2009 Zimmer et al.
2009/0199438 A1 8/2009 Polegato
2009/0235557 A1 9/2009 Christensen et al.
2009/0277047 A1 11/2009 Moretti
2009/0320330 A1 12/2009 Borel et al.
2010/0063778 A1 3/2010 Schrock et al.
2010/0071228 A1 3/2010 Crowley, II et al.
2010/0122472 A1 5/2010 Wilson, III et al.
2010/0154257 A1 6/2010 Bosomworth et al.
2010/0218397 A1 9/2010 Nishiwaki et al.
2010/0222442 A1 9/2010 Prissok et al.
2010/0242309 A1 9/2010 McCann
2010/0287788 A1 11/2010 Spanks et al.
2010/0287795 A1 11/2010 Van Niekerk
2010/0293811 A1 11/2010 Truelsen
2011/0047720 A1 3/2011 Maranan et al.
2011/0067272 A1 3/2011 Lin
2011/0197477 A1 * 8/2011 Mazzarolo ..... A43B 7/06 36/3 B
2011/0232135 A1 9/2011 Dean et al.
2011/0252668 A1 10/2011 Chen et al.
2011/0283560 A1 11/2011 Portzline et al.
2011/0302805 A1 12/2011 Vito
2012/0005920 A1 1/2012 Alvear et al.
2012/0047770 A1 3/2012 Dean et al.
2012/0177777 A1 7/2012 Brown et al.
2012/0186107 A1 7/2012 Crary et al.
2012/0233877 A1 9/2012 Swigart et al.
2012/0233883 A1 9/2012 Spencer et al.
2012/0235322 A1 9/2012 Greene et al.
2012/0266490 A1 10/2012 Atwal et al.
2013/0150468 A1 6/2013 Füssi et al.
2013/0152430 A1 * 6/2013 Bier ..... A43B 7/125 36/3 A
2013/0255103 A1 10/2013 Dua et al.
2013/0266792 A1 10/2013 Nohara et al.
2013/0269215 A1 10/2013 Smirman et al.
2013/0291409 A1 11/2013 Reinhardt et al.
2014/0017450 A1 1/2014 Baghdadi et al.
2014/0033573 A1 2/2014 Wills
2014/0066530 A1 3/2014 Shen et al.
2014/0075787 A1 3/2014 Cartagena
2014/0197253 A1 7/2014 Lofts et al.
2014/0223673 A1 8/2014 Wardlaw et al.
2014/0223776 A1 8/2014 Wardlaw et al.
2014/0223777 A1 8/2014 Whiteman et al.
2014/0223783 A1 8/2014 Wardlaw et al.
2014/0227505 A1 8/2014 Schiller et al.
2014/0366403 A1 12/2014 Reinhardt et al.
2014/0366404 A1 12/2014 Reinhardt et al.
2014/0366405 A1 12/2014 Reinhardt et al.
2014/0373392 A1 12/2014 Cullen
2015/0082668 A1 3/2015 Nakaya et al.
2015/0089841 A1 4/2015 Smaldone et al.
2015/0166270 A1 6/2015 Buscher et al.
2015/0174808 A1 6/2015 Rudolph et al.
2015/0197617 A1 7/2015 Prissok et al.

(56) References Cited

U.S. PATENT DOCUMENTS

| | | | |
|---|---|---|---|
| 2015/0237823 | A1 | 8/2015 | Schmitt et al. |
| 2015/0344661 | A1 | 12/2015 | Spies et al. |
| 2015/0351493 | A1 | 12/2015 | Ashcroft et al. |
| 2016/0037859 | A1 | 2/2016 | Smith et al. |
| 2016/0044992 | A1 | 2/2016 | Reinhardt et al. |
| 2016/0046751 | A1 | 2/2016 | Spies et al. |
| 2016/0121524 | A1 | 5/2016 | Däschlein et al. |
| 2016/0128426 | A1 | 5/2016 | Reinhardt et al. |
| 2016/0227876 | A1 | 8/2016 | Le et al. |
| 2016/0244583 | A1 | 8/2016 | Keppeler |
| 2016/0244584 | A1 | 8/2016 | Keppeler |
| 2016/0244587 | A1 | 8/2016 | Gutmann et al. |
| 2016/0278481 | A1 | 9/2016 | Le et al. |
| 2016/0295955 | A1 | 10/2016 | Wardlaw et al. |
| 2016/0302508 | A1 | 10/2016 | Kormann et al. |
| 2016/0346627 | A1 | 12/2016 | Le et al. |
| 2017/0173910 | A1 | 6/2017 | Wardlaw et al. |
| 2017/0253710 | A1 | 9/2017 | Smith et al. |
| 2017/0259474 | A1 | 9/2017 | Holmes et al. |
| 2017/0340067 | A1 | 11/2017 | Dyckmans et al. |
| 2017/0341325 | A1 | 11/2017 | Le et al. |
| 2017/0341326 | A1 | 11/2017 | Holmes et al. |
| 2017/0341327 | A1 | 11/2017 | Le et al. |
| 2018/0035755 | A1 | 2/2018 | Reinhardt et al. |
| 2018/0093437 | A1 | 4/2018 | Wardlaw et al. |
| 2018/0154598 | A1 | 6/2018 | Kurtz et al. |
| 2018/0206591 | A1 | 7/2018 | Whiteman et al. |
| 2018/0235310 | A1 | 8/2018 | Wardlaw et al. |
| 2018/0290349 | A1 | 10/2018 | Kirupanantham et al. |
| 2018/0303198 | A1 | 10/2018 | Reinhardt et al. |
| 2019/0021435 | A1 | 1/2019 | Kormann et al. |

FOREIGN PATENT DOCUMENTS

| | | | |
|---|---|---|---|
| CN | 1271644 | A | 11/2000 |
| CN | 1313730 | A | 9/2001 |
| CN | 2511160 | | 9/2002 |
| CN | 2796454 | | 7/2006 |
| CN | 2888936 | | 4/2007 |
| CN | 2917346 | Y | 7/2007 |
| CN | 101190049 | | 6/2008 |
| CN | 201223028 | | 4/2009 |
| CN | 101484035 | | 7/2009 |
| CN | 101553146 | A | 10/2009 |
| CN | 101611950 | | 12/2009 |
| CN | 202233324 | | 5/2012 |
| CN | 202635746 | | 1/2013 |
| CN | 202907958 | | 5/2013 |
| CN | 103371564 | | 10/2013 |
| CN | 203692653 | | 7/2014 |
| CN | 203828180 | | 9/2014 |
| DE | 3605662 | | 6/1987 |
| DE | 4236081 | | 4/1994 |
| DE | 19652690 | | 6/1998 |
| DE | 19950121 | | 11/2000 |
| DE | 10010182 | | 9/2001 |
| DE | 20108203 | U1 | 9/2002 |
| DE | 10244433 | | 12/2005 |
| DE | 10244435 | | 2/2006 |
| DE | 102004063803 | | 7/2006 |
| DE | 102005050411 | | 4/2007 |
| DE | 202008017042 | | 4/2009 |
| DE | 102008020890 | | 10/2009 |
| DE | 102009004386 | | 7/2010 |
| DE | 202010008893 | | 1/2011 |
| DE | 112009001291 | | 4/2011 |
| DE | 102010052783 | | 5/2012 |
| DE | 202012005735 | | 8/2012 |
| DE | 102011108744 | | 1/2013 |
| DE | 102012206094 | | 10/2013 |
| DE | 102013208170 | | 11/2014 |
| EM | 001286116-0001 | | 7/2011 |
| EM | 001286116-0002 | | 7/2011 |
| EM | 001286116-0003 | | 7/2011 |
| EM | 001286116-0004 | | 7/2011 |
| EM | 001286116-0005 | | 7/2011 |
| EM | 001286116-0006 | | 7/2011 |
| EP | 165353 | | 12/1985 |
| EP | 752216 | | 1/1997 |
| EP | 873061 | | 10/1998 |
| EP | 1197159 | A1 | 4/2002 |
| EP | 1424105 | | 6/2004 |
| EP | 1197159 | B1 | 9/2004 |
| EP | 1402796 | B1 | 1/2006 |
| EP | 1854620 | | 11/2007 |
| EP | 1872924 | | 1/2008 |
| EP | 2110037 | | 10/2009 |
| EP | 2233021 | | 9/2010 |
| EP | 2250917 | | 11/2010 |
| EP | 2316293 | | 5/2011 |
| EP | 2342986 | | 7/2011 |
| EP | 2446768 | | 5/2012 |
| EP | 2649896 | | 10/2013 |
| EP | 2540184 | | 7/2014 |
| EP | 2792261 | | 10/2014 |
| EP | 2848144 | | 3/2015 |
| EP | 2939558 | | 11/2015 |
| EP | 3067100 | | 9/2016 |
| FR | 2683432 | | 5/1993 |
| GB | 2258801 | | 2/1993 |
| JP | 4638359 | B2 | 11/1971 |
| JP | 01274705 | | 11/1989 |
| JP | H03502286 | | 5/1991 |
| JP | 04502780 | | 5/1992 |
| JP | 6046483 | | 6/1994 |
| JP | H0662802 | | 9/1994 |
| JP | H07-265103 | A | 10/1995 |
| JP | H08-107803 | A | 4/1996 |
| JP | 2640214 | | 8/1997 |
| JP | H09-309124 | A | 12/1997 |
| JP | 10152575 | | 6/1998 |
| JP | 2000197503 | | 7/2000 |
| JP | 2002361749 | | 12/2002 |
| JP | 2005-000347 | A | 1/2005 |
| JP | 2005-095388 | A | 4/2005 |
| JP | 2005218543 | | 8/2005 |
| JP | 2006-20656 | | 1/2006 |
| JP | 2006-137032 | | 6/2006 |
| JP | 2006-325901 | A | 12/2006 |
| JP | 2006-346397 | A | 12/2006 |
| JP | 2007516109 | | 6/2007 |
| JP | 2007-275275 | | 10/2007 |
| JP | 2008073548 | | 4/2008 |
| JP | 2008-110176 | A | 5/2008 |
| JP | 2008543401 | | 12/2008 |
| JP | 2011-516127 | A | 5/2011 |
| KR | 20050005614 | | 1/2005 |
| KR | 1020110049293 | | 5/2011 |
| TW | 201012407 | | 4/2010 |
| WO | 8906501 | | 7/1989 |
| WO | 1994020568 | | 9/1994 |
| WO | 2005026243 | | 3/2005 |
| WO | 2005038706 | | 4/2005 |
| WO | 2005066250 | | 7/2005 |
| WO | 2006015440 | | 2/2006 |
| WO | 2006034807 | | 4/2006 |
| WO | 2006134033 | | 12/2006 |
| WO | 2007082838 | | 7/2007 |
| WO | 2008047538 | | 4/2008 |
| WO | 2008087078 | | 7/2008 |
| WO | 2009036173 | | 3/2009 |
| WO | 2009/039555 | A1 | 4/2009 |
| WO | 2009095935 | | 8/2009 |
| WO | 2009/146368 | A1 | 12/2009 |
| WO | 2010010010 | | 1/2010 |
| WO | 2010/038266 | A1 | 4/2010 |
| WO | 2010037028 | | 4/2010 |
| WO | 2010045144 | | 4/2010 |
| WO | 2010136398 | | 12/2010 |
| WO | 2011134996 | | 11/2011 |
| WO | 2012065926 | | 5/2012 |
| WO | 2012135007 | | 10/2012 |
| WO | 2013013784 | | 1/2013 |
| WO | 2013168256 | | 11/2013 |

(56) References Cited

FOREIGN PATENT DOCUMENTS

| | | |
|---|---|---|
| WO | 2014046940 | 3/2014 |
| WO | 2015052265 | 4/2015 |
| WO | 2015052267 | 4/2015 |
| WO | 2015075546 | 5/2015 |

OTHER PUBLICATIONS

Office Action, Japanese Patent Application No. 2019-188956, dated Jan. 19, 2021, 8 pages.
Adidas Brief filed with Regional Court of Frankfurt, Dec. 17, 2013, pp. 34-42.
Adidas Brief filed with the Regional Court of Frankfurt, Nov. 3, 2014, pp. 19-22.
Adidas Brief filed with the Regional Court of Frankfurt, Mar. 25, 2014, pp. 22-26.
Adidas Brief filed with the Regional Court of Frankfurt, May 27, 2014, pp. 37-38.
Adidas Brief filed with the Regional Court of Frankfurt, Dec. 17, 2013, pp. 50-54.
Adidas Brief filed with the Regional Court of Frankfurt, Dec. 17, 2013, pp. 57-59.
Adidas Brief filed with the Regional Court of Frankfurt, May 11, 2015, pp. 7-11.
European Extended Search Report, European Patent Application No. 19197025.0, dated Dec. 11, 2019, 8 pages.
Overview of Prior Art Cited in the Frankfurt Design Case Against Puma, Dec. 17, 2013, 8 pages.
Photo of Adidas AC 103 4 Chamois and AC 104 1 Rubis Sports Shoes, Apr. 11, 2013, 1 page.
Photo of Adidas AC 127 8 Forum Sports Shoe, Apr. 11, 2013, 1 page.
U.S. Appl. No. 29/697,489, filed Jul. 9, 2019, Unpublished.
U.S. Appl. No. 29/694,634, filed Jun. 12, 2019, Unpublished.
U.S. Appl. No. 29/719,889, filed Jan. 8, 2020, Unpublished.
U.S. Appl. No. 29/706,274, filed Sep. 19, 2019, Unpublished.
U.S. Appl. No. 29/721,029, filed Jan. 17, 2020, Unpublished.
U.S. Appl. No. 16/908,945, filed Jun. 23, 2020, Unpublished.
U.S. Appl. No. 16/918,905, filed Jul. 1, 2020, Unpublished.
U.S. Appl. No. 16/918,014, filed Jul. 1, 2020, Unpublished.
U.S. Appl. No. 16/918,241, filed Jul. 1, 2020, Unpublished.
U.S. Appl. No. 17/004,430, filed Aug. 27, 2020, Unpublished.
"Colour and Additive Preparations for Extruded Polyolefin Foams", Gabriel-Chemie Group, available at www.gabriel-chemie.com/downloads/folder/PE%20foams_en.pdf, last accessed on Jan. 17, 2017, 20 pages.
"http://www.dow.com/polyethylene/na/en/fab/foaming.htm", Dec. 7, 2011, 1 page.
"https://www.britannica.com/print/article/463684", Aug. 17, 2016.
U.S. Appl. No. 14/178,720, Advisory Action, dated Apr. 12, 2017, 3 pages.
U.S. Appl. No. 14/178,720, Final Office Action, dated Feb. 1, 2017, 11 pages.
U.S. Appl. No. 14/178,720, Non-Final Office Action, dated Oct. 25, 2016, 13 pages.
U.S. Appl. No. 14/178,720, Notice of Allowance, dated May 31, 2017, 8 pages.
U.S. Appl. No. 14/178,720, Restriction Requirement, dated Aug. 17, 2016, 5 pages.
U.S. Appl. No. 14/178,720, Restriction Requirement, dated May 23, 2016, 6 pages.
U.S. Appl. No. 15/581,112, Unpublished (filed Apr. 28, 2017).
U.S. Appl. No. 29/591,016, Unpublished (filed Jan. 16, 2017).
U.S. Appl. No. 29/592,946, Unpublished (filed Feb. 3, 2017).
U.S. Appl. No. 29/592,935, Unpublished (filed Feb. 3, 2017).
U.S. Appl. No. 29/594,228, Unpublished (filed Feb. 16, 2017).
U.S. Appl. No. 29/594,358, Unpublished (filed Feb. 17, 2017).
U.S. Appl. No. 29/595,852, Unpublished (filed Mar. 2, 2017).
U.S. Appl. No. 29/595,857, Unpublished (filed Mar. 2, 2017).
U.S. Appl. No. 29/595,859, Unpublished (filed Mar. 2, 2017).
U.S. Appl. No. 29/614,532, Unpublished (filed Aug. 21, 2017).
U.S. Appl. No. 29/614,545, Unpublished (filed Aug. 21, 2017).
U.S. Appl. No. 62/137,139, Unpublished (filed Mar. 23, 2016).
AZO Materials, "BASF Develops Expanded Thermoplastic Polyurethane", available http://www.azom.com/news.aspxNewsID=37360, Jul. 2, 2013, 4 pages.
Baur et al., "Saechtling Kunststoff Taschenbuch", Hanser Verlag, 31st Ausgabe, Oct. 2013, 18 pages (9 pages for the original document and 9 pages for the English translation).
Gunzenhausen et al., "The right turn (part 1)—Determination of Characteristic values for assembly injection molding", Journal of Plastics Technology, Apr. 2008, pp. 1-8 (English translation of Abstract provided).
Chinese Patent Application No. 201410049613.4, Office Action, dated Jul. 27, 2015, 11 pages.
European Patent Application No. 14152906.5, European Search Report, dated May 6, 2014, 6 pages.
Nauta, "Stabilisation of Low Density, Closed Cell Polyethylene Foam", University of Twente, Netherlands, 2000, 148 pages.
Office Action, Chinese Patent Application No. 201410049613.4, dated Dec. 30, 2016, 8 pages.
Office Action, Japanese Patent Application No. 2014-021229, dated Jun. 13, 2017.
Venable LLP, "Letter", Jan. 14, 2016, 6 pages.
Office Action, Japanese Patent Application No. 2014-021229, dated Feb. 20, 2018.
Office Action, Japanese Patent Application No. 2014-021229, dated Feb. 5, 2019, 6 pages.
U.S. Appl. No. 29/663,342, filed Sep. 13, 2018, Unpublished.
U.S. Appl. No. 29/664,097, filed Sep. 21, 2018, Unpublished.
U.S. Appl. No. 16/353,374, filed Mar. 14, 2019, Unpublished.
U.S. Appl. No. 29/595,859, filed Mar. 2, 2017, Unpublished.
U.S. Appl. No. 29/691,166, filed May 14, 2019, Unpublished.
U.S. Appl. No. 29/643,233, filed Apr. 5, 2018, Unpublished.
U.S. Appl. No. 29/641,371, filed Mar. 21, 2018, Unpublished.
U.S. Appl. No. 29/663,029, filed Sep. 11, 2018, Unpublished.
U.S. Appl. No. 29/641,256, filed Mar. 20, 2018, Unpublished.
U.S. Appl. No. 29/641,223, filed Mar. 20, 2018, Unpublished.
U.S. Appl. No. 29/691,854, filed May 20, 2019, Unpublished.
U.S. Appl. No. 29/679,962, filed Feb. 12, 2019, Unpublished.
U.S. Appl. No. 29/693,455, filed Jun. 3, 2019, Unpublished.
U.S. Appl. No. 16/465,485, filed May 30, 2019, Unpublished.
U.S. Appl. No. 15/703,031, Restriction Requirement, dated Jan. 4, 2019.
U.S. Appl. No. 15/703,031, Non-Final Office Action, dated Jun. 14, 2019.
U.S. Appl. No. 15/703,031, Notice of Allowance, dated Aug. 14, 2019.
Office Action, Chinese Patent Application No. 201810071758.2, dated Sep. 27, 2020, 23 pages.
Decision of Rejection, Japanese Patent Application No. 2019-188956, dated Aug. 3, 2021, 4 pages.

* cited by examiner

CUSHIONING ELEMENT FOR SPORTS APPAREL

CROSS REFERENCE TO RELATED APPLICATION

This application is a continuation of U.S. application Ser. No. 15/703,031, filed Sep. 13, 2017, entitled CUSHIONING ELEMENT FOR SPORTS APPAREL ("the '031' application"), which is a divisional application of U.S. application Ser. No. 14/178,720, filed on Feb. 12, 2014, entitled CUSHIONING ELEMENT FOR SPORTS APPAREL ("the '720 application"), now U.S. Pat. No. 9,781,970, which claims priority benefits from German Patent Application No. DE 10 2013 202 291.3, filed on Feb. 13, 2013, entitled CUSHIONING ELEMENT FOR SPORTS APPAREL ("the '291 application"), and from European Patent Application No. EP 14 152 906.5, filed on Jan. 28, 2014, entitled CUSHIONING ELEMENT FOR SPORTS APPAREL ("the '906 application"). The '031, '720, '291 and '906 applications are hereby incorporated herein in their entireties by this reference.

FIELD OF THE INVENTION

The present invention concerns cushioning elements for sports apparel, in particular a sole for a sports shoe.

BACKGROUND

Cushioning elements play a great role in the field of sports apparel and are used for clothing for the most varied types of sports. Exemplarily, winter sports clothing, running wear, outdoor clothing, football wear, golf clothing, martial arts apparel or the like may be named here. Generally, cushioning elements serve to protect the wearer from shocks or blows, and for padding, for example, in case the wearer falls down. For this, the cushioning elements typically comprise one or more deformation elements that deform under an external effect of pressure or a shock impact and thereby absorb the impact energy.

A particularly important role is to be attributed to the cushioning elements in the construction of shoes, especially sports shoes. By means of cushioning elements in the form of soles, shoes are provided with a large number of different properties which may vary considerably, according to the specific type of the shoe. Primarily, shoe soles have a protective function. By their stiffness, which is higher than that of the shoe shaft, they protect the foot of the respective wearer against injuries caused, e.g., by pointed or sharp objects that the wearer of the shoe may step on. Furthermore, the shoe sole, due to its increased abrasion resistance, usually protects the shoe against excessive wear. In addition, shoe soles may improve the contact of the shoe on the respective ground and thereby enable faster movements. A further function of a shoe sole may comprise providing certain stability. Moreover, a shoe sole may have a cushioning effect in order to, e.g., cushion the effects produced by the contact of the shoe with the ground. Finally, a shoe sole may protect the foot from dirt or spray water and/or provide a large variety of other functionalities.

In order to accommodate the large number of functionalities, different materials are known from the prior art which may be used for manufacturing cushioning elements for sports apparel.

Exemplarily, reference is made here to cushioning elements made of ethylene-vinyl-acetate (EVA), thermoplastic polyurethane (TPU), rubber, polypropylene (PP) or polystyrene (PS), in the form of shoe soles. Each of these different materials provides a particular combination of different properties that are more or less well suited for soles of specific shoe types, depending on the specific requirements of the respective shoe type. For instance, TPU is very abrasion-resistant and tear-resistant. Furthermore, EVA distinguishes itself by having a high stability and relatively good cushioning properties. Furthermore, the use of expanded materials, in particular, of expanded thermoplastic urethane (eTPU) was taken into account for the manufacture of a shoe sole. Expanded thermoplastic urethane has a low weight and particularly good properties of elasticity and cushioning. Furthermore, according to WO 2005/066250, a sole of expanded thermoplastic urethane may be connected to a shoe shaft without additional adhesive agents.

Moreover, US 2005/0150132 A1 discloses footwear (e.g., shoes, sandals, boots, etc.) that is constructed with small beads stuffed into the footbed, so that the beads may shift about due to pressure on the footbed by the user's foot during normal use. DE 10 2011 108 744 A1 discloses a method for the manufacture of a sole or part of a sole for a shoe. WO 2007/082838 A1 discloses foams based on thermoplastic polyurethanes. US 2011/0047720 A1 discloses a method of manufacturing a sole assembly for an article of footwear. Finally, WO 2006/015440 A1 discloses a method of forming a composite material.

One disadvantage of the cushioning elements which are known from prior art, in particular of the known shoe soles, is that these have a low breathability. This disadvantage may considerably restrict the wearing comfort of the sports clothing that contains the cushioning element, since it leads to increased formation of sweat or heat accumulation under the clothing. This is disadvantageous particularly in cases where the clothing is worn continuously for a longer time, as, for instance, during a walking tour or a round of golf or during winter sports. Furthermore, cushioning elements often increase the overall weight of the sports clothing in a an amount that is not insignificant. This may have an adverse effect on the wearer's performance, in particular in sports of endurance or running.

Starting from prior art, it is therefore an object of the present invention to provide better cushioning elements for sports apparel, in particular for soles for sports shoes. A further object of the present invention comprises improving the breathability of such a cushioning element and in further reducing its weight.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a cushioning element for sports apparel, in particular for a sole of a sports shoe, comprises a first deformation element having a plurality of randomly arranged particles of an expanded material, wherein there are first voids within the particles and/or between the particles.

The use of expanded material for the construction of a deformation element for a cushioning element of sports clothing may be beneficial, as this material is very light and has, at the same time, very good cushioning properties. The use of randomly arranged particles of the expanded material facilitates the manufacture of such a cushioning element considerably, since the particles may be handled easily and no particular orientation is necessary during the manufacture. So, for instance, the particles may be filled, under pressure and/or by using a transport fluid, into a mold used for producing the deformation element or the cushioning element, respectively. Due to the voids between or within the particles of the expanded material, the weight of the deformation element and thus of the cushioning element is further reduced.

In certain embodiments, the particles of the expanded material comprise one or more of the following materials: expanded ethylene-vinyl-acetate, expanded thermoplastic urethane, expanded polypropylene, expanded polyamide, expanded polyether block amide, expanded polyoxymethylene, expanded polystyrene, expanded polyethylene, expanded polyoxyethylene, and expanded ethylene propylene diene monomer. According to the specific profile requirements, one or more of these materials may be used for the manufacture due to their substance-specific properties.

In certain embodiments, the particles of the expanded material have one or more of the following cross-sectional profiles: ring-shaped, oval, square, polygonal, round, rectangular, and star-shaped. By the form of the particles, the size, the arrangement, and the shape of the voids between and/or within the particles and thus the density of the finished deformation element may be influenced, which may have effects on the weight, heat insulation, and breathability of the cushioning element.

According to other embodiments of the invention, the first deformation element is manufactured by inserting the particles of the expanded material into a mold and exposing them after said insertion into the mold to a heating and/or pressurizing and/or steaming process. Thereby, the surfaces of the particles may be melted at least in part, so that the surfaces of the particles bond after cooling. Furthermore, the particles, due to the heating and/or pressurizing and/or steaming process, may also form a bond by a chemical reaction. Such a bond is highly robust and durable and does not require a use of further bonding agents, e.g. adhesives.

As a result, a cushioning element may be manufactured with a first deformation element comprising a "loose" arrangement of randomly arranged particles of the expanded material, with voids and also channels or cavities (cf. below) in between the randomly arranged particles, or even a network of such voids, channels and cavities, without the danger of losing the necessary stability of the first deformation element. By at least partially fusing the particle surfaces, e.g. by means of a steaming process or some other process, the resulting bond is strong enough to ensure that, in particular, particles arranged at the surface of such a first deformation element or cushioning element are not "picked off" during use of the element.

Moreover, the manufacture of such elements are, inter alia, simpler, safer, more cost-effective and more environment-friendly. By adjusting, e.g., the pressure or the duration of the treatment, the size and shape of the voids between the particles of the expanded materials may be influenced, which, as already mentioned, may have effects on the weight, heat insulation, and breathability of the cushioning element.

In certain embodiments, before being inserted into the mold, the particles may comprise a density of 10-150 g/l, and may further comprise a density of 10-100 g/l, and may even further comprise a density of 10-50 g/l.

According to further embodiments of the invention, the first deformation element may be manufactured by intermixing the particles of the expanded material with a further material which is removed later or which remains at least in part in the first voids of the first deformation element, which enables, on the one hand, a further exertion of influence on the properties of the voids forming between the particles. If, on the other hand, the second material is not removed completely from the voids, it may increase the stability of the deformation element.

In further embodiments, a solidified liquid resides in the first voids of the deformation element. This solidified liquid may, for instance, be a transport fluid, which is used for filling a form with the particles of the expanded material and which has solidified during the heating and/or pressurizing and/or steaming process. Alternatively, the particles inserted in the mold may also be coated continuously with the liquid during the heat and/or pressure and/or steam treatment, whereby said liquid solidifies gradually.

Preferably, the first voids form one or more cavities in which air is trapped. In this manner, the heat insulation of the cushioning element may be increased.

As will be appreciated, air may comprise a lower heat conduction than solid materials, e.g. the particles of the expanded material. Hence, by interspersing the first deformation element with air filled cavities, the overall heat conduction of the first deformation element and thus the cushioning element may be reduced so that the foot of a wearer, e.g., is better insulated against loss of body heat through the foot.

In principle, the cavities could also trap another type of gas or liquid inside them or they could be evacuated.

According to further embodiments of the invention, the first voids form one or more channels through the first deformation element that are permeable to air and/or liquids. Thereby, the breathability of the deformation element is increased.

In this case, the use of randomly arranged particles may be advantageous. By the random arrangement, such channels develop independently with a certain statistical probability without requiring a specific arrangement of the particles when they are filled into a mold, which reduces the manufacturing expenses of such a deformation element significantly.

It will be appreciated that in general some of the first voids may form one or more cavities that trap air inside them and some of the first voids may form one or more channels throughout the first deformation element which are permeable to air and/or liquids.

Whether the first voids between the randomly arranged particles predominantly form cavities that trap air inside them or predominantly form channels as described above may depend on the size, shape, material, density, and so forth of the randomly arranged particles and also on the manufacturing parameters like temperature, pressure, packing density of the particles, etc. It may also depend on the pressure load on the first deformation element.

For example, a first deformation element arranged in the heel region or forefoot region of a shoe will experience a strong compression during a gait cycle, e.g. during landing on the heel or push-off over the forefoot. Under such a pressure load, potential channels through the first deformation element might be sealed by the compressed and deformed randomly arranged particles. Also, during landing or push-off, the foot may be in close contact with the inner surface of the shoe. This design might reduce the breathability of the sole. The sealing of the channels may, however, lead to the formation of additional cavities within the first deformation element, trapping air inside them, and may thus increase the heat insulation of the sole, which is particularly important when the sole contacts the ground, because here a large amount of body heat might be lost.

After push-off of the foot, on the other hand, the randomly arranged particles of the first deformation element might re-expand, leading to a re-opening of the channels. Also, in the expanded state, some of the cavities present in the loaded state might open up and form channels through the first deformation element that are permeable to air and/or liquids. Also, the foot may not be in tight contact with the inner surface of the shoe anymore during such periods of the gait cycle. Hence, breathability might be increased during this phase, while heat insulation might be reduced.

This interplay between the formation of channels and cavities within the first deformation element depending on the state of compression may provide a preferred direction for airflow through the first deformation element, e.g. in the direction of the compression and re-expansion of the first deformation element. For a first deformation element arranged in the sole of a shoe, e.g., the compression and re-expansion in a direction from the foot to the ground during a gait cycle may guide and control an airflow in the direction from the ground through the first deformation element to the foot, or out of the shoe.

Such a guided airflow may, in particular, be employed in combination with the high energy return provided by a first deformation element comprising randomly arranged particles of an expanded material, e.g. eTPU. For example, a first deformation element arranged in the forefoot region comprising randomly arranged particles of eTPU may provide high energy return to the foot of a wearer when pushing off over the toes. The re-expansion of the first deformation element after push-off may also lead to a guided or directed inflow of air into the forefoot region, leading to good ventilation and cooling of the foot. The re-expansion of the first deformation element may even lead to a suction effect, sucking air into channels through the first deformation element, and may thus facilitate ventilation and cooling of the foot even further. Such an efficient cooling may provide the foot of a wearer with additional "energy" and generally improve performance, well-being and endurance of an athlete.

While the above example was specifically directed to a first deformation element arranged in the forefoot region, its main purpose was to exemplify the advantageous combination of energy return and directed airflow that may be provided by embodiments of inventive cushioning elements with first deformation elements. It is clear to the skilled person that this effect may also be advantageously employed in other regions of a sole or in entirely different sports apparel. Herein, the direction of compression and re-expansion and the direction of guidance of the airflow may vary depending on the specific arrangement of the first deformation element and its intended use.

In addition, it is also possible that the manufacture of the cushioning element comprises the creation of one or more predefined channels through the first deformation element that are permeable to air and/or liquids.

This design allows further balancing the heat insulating properties vs. the breathability of the cushioning element, for example. The predefined channel(s) may for example be created by corresponding protrusions or needles in a mold that is used for the manufacture of the cushioning element.

In further embodiments, the cushioning element may comprise a reinforcing element, in particular, a textile reinforcing element and/or a foil-like reinforcing element and/or a fiber-like reinforcing element, which enables manufacture of a deformation element with very low density/very low weight and a high number of voids and ensures, at the same time, the necessary stability of the deformation element.

In certain embodiments, the reinforcing element is provided as a foil comprising thermoplastic urethane. Thermoplastic urethane foils are well suited for use in combination with particles of expanded material, especially particles of expanded thermoplastic urethane.

Furthermore, in preferred embodiments, the foil may be permeable to air and/or liquids in at least one direction. So, the foil may, for instance, be permeable to air in one or both directions, while being permeable to liquids only in one direction, thus being able to protect against moisture from the outside, e.g. water.

In certain embodiments, a cushioning element in which the first voids form one or more channels permeable to air and/or liquids through the first deformation element, is combined with a reinforcing element, in particular a textile reinforcing element and/or a foil-like reinforcement element, especially a foil comprising thermoplastic urethane, and/or a fiber-like reinforcing element, whereby the reinforcing element comprises at least one opening which is arranged in such a way that air and/or liquid passing through one or more channels in the first deformation element may pass in at least one direction through the at least one opening of the reinforcing element. This feature enables a sufficient stability of the deformation element without influencing the breathability provided by the channels. In case the at least one opening of the reinforcing element is, for example, only permeable to liquids in the direction from the foot towards the outside, the reinforcing element may also serve to protect from moisture from the outside.

According to further embodiments of the invention, the first deformation element takes up a first partial region of the cushioning element, and the cushioning element further comprises a second deformation element. Thereby, the properties of the cushioning element may be selectively influenced in different areas, which increases the constructive freedom and the possibilities of exerting influence significantly.

In certain embodiments, the second deformation element comprises a plurality of randomly arranged particles of an expanded material, whereby second voids are provided within the particles and/or between the particles of the second deformation element, which on average are smaller than the first voids of the first deformation element. In this case, a size of the second voids, which is smaller on average, may translate into a greater density of the expanded material of the second deformation material and thus a higher stability and deformation stiffness. The smaller size of the second voids could also result in also a lower breathability. By combining different deformation elements with voids of different sizes (on average), the properties of deformation elements may be selectively influenced in different areas.

It is for example conceivable that the randomly arranged particles in the first deformation element and the manufacturing parameters are chosen such that the first voids predominantly form channels throughout the first deformation element permeable to air and/or liquids, thus creating good breathability in this region. The randomly arranged particles in the second deformation element and the manufacturing parameters may be chosen such that the second voids predominantly form cavities trapping air inside them, thus creating good heat insulation in this region. The opposite is also conceivable.

In certain embodiments, the cushioning element is designed as at least one part of a shoe sole, in particular at least as a part of a midsole. In certain embodiments, the cushioning element is designed as at least a part of an insole of a shoe. Hereby, different embodiments of deformation elements with different properties each may be combined with each other and/or be arranged in preferred regions of the sole and/or the midsole and/or the insole. For example, the toe region and the forefoot region are preferred regions where permeability to air should be enabled. Furthermore, the medial region is preferably configured more inflexibly so as to ensure a better stability. In order to optimally support the walking conditions of a shoe, the heel region and the forefoot region of a sole preferably have a particular padding. Owing to the most varied requirements for different shoe types and kinds of sports, the sole may be adapted exactly to the requirements, according to the aspects described herein.

According to further embodiments of the invention, a possibility to arrange the different regions or the different deformation elements, respectively, in a cushioning element comprises manufacturing these in one piece in a manufacturing process. To do so, for example, a mold is loaded with one or more types of particles of expanded materials. For instance, a first partial region of the mold is loaded with a first type of particles of an expanded material, and a second partial region of the mold is loaded with a second type of particles. The particles may differ in their starting materials, their size, their density, their color etc. In addition, individual partial regions of the mold may also be loaded with non-expanded material. After insertion of the particles and, if necessary, further materials into the mold, these may be subjected, as already described herein, to a pressurizing and/or steaming and/or heating process. By an appropriate selection of the parameters of the pressurizing and/or steaming and/or heating process—such as, for example, the pressure, the duration of the treatment, the temperature, etc.—in the individual partial regions of the mold as well as by suitable tool and machine adjustments, the properties of the manufactured cushioning element may be further influenced in individual partial regions.

Further embodiments of the invention concerns a shoe, in particular a sports shoe, with a sole, in particular a midsole and/or an insole, according to one of the previously cited embodiments. Hereby, different aspect of the cited embodiments and aspects of the invention may be combined in an advantageous manner, according to the profile of requirements concerning the sole and the shoe. Furthermore, it is possible to leave individual aspects aside if they are not important for the respective intended use of the shoe.

BRIEF DESCRIPTION OF THE DRAWINGS

In the following detailed description, embodiments of the invention are described referring to the following figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, embodiments of the invention are described with respect to midsoles. However, it is pointed out that the present invention is not limited to these embodiments. For example, the present invention may also be used for insoles as well as other sportswear, e.g. for shin-guards, protective clothing for martial arts, cushioning elements in the elbow region or the knee region for winter sports clothing and the like.

Figure 1:
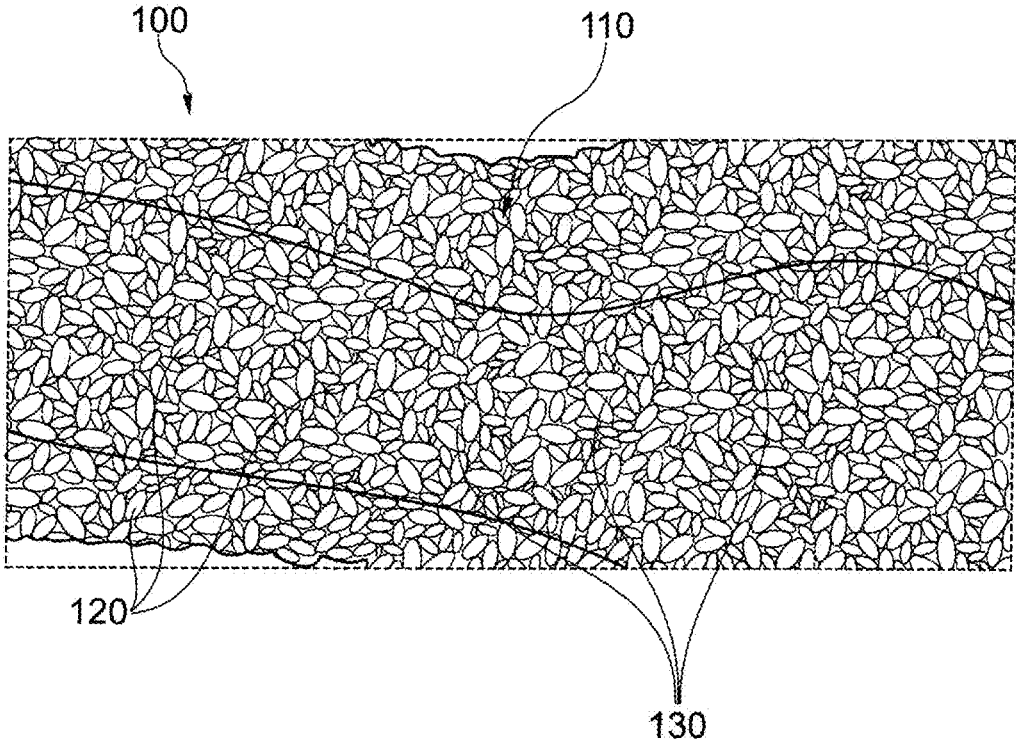
FIG. 1 is a top view of a cushioning element configured as midsole, according to certain embodiments of the present invention.

FIG. 1 shows a cushioning element 100 configured as part of a midsole, according to certain embodiments of the invention, which comprises a deformation element 110. The deformation element 110 has a plurality of randomly arranged particles 120 of an expanded material, whereby first voids 130 are comprised within the particles 120 and/or between the particles 120.

In the embodiments shown in FIG. 1, the deformation element 110 constitutes the whole cushioning element 100. In further preferred embodiments, however, the deformation element 110 takes up only one or more partial regions of the cushioning element 100. It is also possible that the cushioning element 100 comprises several deformation elements 110, which each form a partial region of the cushioning element 100. Thereby, the different deformation elements 110 in the various partial regions of the cushioning element 100 may comprise particles 120 of the same expanded material or of different expanded materials. The voids 130 between the particles 120 of the expanded material of the respective deformation elements 110 may each, on average, also have the same size or different sizes.

The average size of the voids is to be determined, for example, by determining the volume of the voids in a defined sample amount of the manufactured deformation element, e.g. in 1 cubic centimeter of the manufactured deformation element. A further possibility to determine the average size of the voids is, for example, to measure the diameter of a specific number of voids, e.g. of 10 voids, and to subsequently form the mean value of the measurements. As a diameter of a void, for example, the largest and the smallest distance between the walls of the respective void may come into play, or another value which may be consistently measured by the skilled person.

By an appropriate combination of different expanded materials and/or different average sizes of the voids 130, deformation elements 110 with different properties for the construction of a cushioning element 100 may be combined with each other. Thereby, the properties of the cushioning element 100 may be influenced locally by selection.

To reiterate, the cushioning elements 100, according to one or more aspects of the present invention, as shown in FIG. 1, are not only suitable for manufacturing shoe soles, but may also be advantageously used in the field of other sports apparel.

In certain embodiments, the particles 120 of the expanded material may comprise in particular one or more of the following materials: expanded ethylene-vinyl-acetate (eEVA), expanded thermoplastic urethane (eTPU), expanded polypropylene (ePP), expanded polyamide (ePA), expanded polyether block amid (ePEBA), expanded polyoxymethylene (ePOM), expanded polystyrene (ePS), expanded polyethylene (ePE), expanded polyethylene (ePOE), expanded polyoxyethylene (ePOE), and expanded ethylene-propylene-diene monomer (eEPDM).

Each of these materials has characteristic properties which, according to the respective requirement profile of the cushioning element 100, may be advantageously used for manufacture. So, in particular, eTPU has excellent cushioning properties which remain unchanged at higher or lower temperatures. Furthermore, eTPU is very elastic and returns the energy stored during compression almost completely during subsequent expansion, which may be helpful in embodiments of cushioning elements 100 that are used for shoe soles.

For manufacturing such a cushioning element 100, the particles 120 of the expanded material, according to further embodiments of the invention, may be introduced into a mold and subjected to a heating and/or pressurization and/or steaming process after filling the mold. By varying the parameters of the heating and/or pressurization and/or steaming process, the properties of the manufactured cushioning elements may be further influenced. As a result, it may be possible to influence the resulting thickness of the manufactured cushioning element or the shape or the size, respectively, of the voids 130 by the pressure to which the particles 120 are subjected in the mold. The thickness and the size of the voids 130 may thereby depend also on the pressure used for inserting the particles 120 into the mold. Therefore, in some embodiments, the particles 120 may be introduced into the mold by means of compressed air or a transport fluid.

The thickness of the manufactured cushioning element 100 is further influenced by the (mean) density of the particles 120 of the expanded material before filling the mold. In some embodiments, before filling the mold, this density lies in a range between 10-150 g/l, and may further lie in a range between 10-100 g/l, and may even further lie in a range of 10-50 g/l. These ranges may be beneficial for the manufacture of cushioning elements 100 for sports apparel, in particular for shoe soles. According to the specific profile requirements for sports apparel, however, other densities are imaginable too. For example, higher densities come into consideration for a cushioning element 100 of a shin-guard which has to absorb higher forces, whereas lower densities are also possible for a cushioning element 100 in a sleeve. In general, by appropriately selecting the density of the particles 120, the properties of the cushioning element 100 may be advantageously influenced according to the respective profile requirements.

It is to be appreciated that the manufacturing methods, options, and parameters described herein allow the manufacture of a cushioning element 100 with a first deformation element 110 comprising a "loose" arrangement of randomly arranged particles 120, as shown in FIG. 1. Even in the presence of first voids 130, which may further form channels or cavities (cf. below) or even a network of voids, channels and cavities in between the randomly arranged particles 120, the necessary stability of the first deformation element 110 may be provided. For example, by at least partially fusing the surfaces of the particles 120 by means of a steaming process or other processes, the resulting bond is strong enough to ensure that particles 120 arranged at the surface of such a first deformation element 110 or cushioning element 100 are not "picked off" during use.

According to further embodiments of the invention, the particles 120 of the expanded material for the manufacture of the cushioning element 100 are first intermixed with a further material. The particles may be of another expanded or non-expanded material, a powder, a gel, a liquid, or the like. In certain embodiments, wax-containing materials or materials that behave like wax are used. In certain embodiments, the additional material is removed from the voids 130 in a later manufacturing step, for example, after filling the mixture into a mold and/or after a heating and/or pressurizing and/or steaming process. The additional material may, for example, be removed again from the voids 130 by a further heat treatment, by compressed air, by means of a solvent, or by other suitable process. By an appropriate selection of the further material and of the ratio between the amount of particles 120 and the amount of further material, as well as the manner in which the further material is removed again, the properties of the deformation element 110 and thereby of the cushioning element 100 and, in particular, the shape and size of the voids 130 may be influenced. In other embodiments of the present invention, the additional material may remain at least partially in the voids 130, which may have a positive influence on stability and/or tensile strength of the cushioning element 100.

According to further embodiments of the invention, the particles 120 may also show different cross-sectional profiles. There may, for example, be particles 120 with ring-shaped, oval, square, polygonal, round, rectangular, or star-shaped cross-section. The particles 120 may have a tubular form, i.e. comprise a channel, or else may have a closed surface which may surround a hollow space inside. The shape of the particles 120 has a substantial influence on the packing density of the particles 120 after insertion into the mold. The packing density depends further on, e.g., the pressure under which the particles 120 are filled into the mold or to which they are subjected in the mold, respectively. Furthermore, the shape of the particles 120 has an influence on whether the particles 120 comprise a continuous channel or a closed surface. The same applies to the pressure used during the filling of the mold and/or within the mold, respectively. In a similar manner, the shape and the average size of the voids 130 between the particles 120 may be influenced.

Furthermore, the configuration of the particles 120 and the pressure used during filling and/or in the mold determine the likelihood that the voids 130 form one or more channels permeable to air and/or to liquids through the deformation element 110. As the particles 120 are arranged randomly, according to certain embodiments of the invention, such continuous channels develop, with certain statistical likelihood, independently without the need of specific expensive manufacturing processes, such as an alignment of the particles 120 or the use of complicated molds. The likelihood of this autonomous channel formation depends, inter alia, on the shape of the particles 120, in particular on the maximum achievable packing density of the particles 120 within a given shape. So, for instance, cuboid particles 120 may, as a rule, be packed more densely than star-shaped or round/oval particles 120, which leads to smaller voids 130 on average and to a reduced likelihood of the development of channels permeable to air and/or liquids. There is also a higher probability that channels develop that are permeable to air, because air is gaseous and therefore able to pass through very small channels which are not permeable to liquids due to the surface tension of the liquid. As a result, deformation elements 110 may be manufactured without increased manufacturing efforts by an appropriate selection of the shape and size of the particles 120 and/or an appropriate filling pressure of the particles 120, and/or an adaption of the parameters of the heating and/or pressurizing and/or steaming process to which the particles 120 are possibly subjected in the mold, these deformation elements 110 being indeed breathable, while also being impermeable to liquids. This combination of properties is particularly advantageous for sports apparel which is worn outdoors.

Moreover, the first voids 130 may also form one or more cavities in which air is trapped. In this manner, the heat insulation of the cushioning element 100 may be increased. As will be appreciated, air may comprise a lower heat conduction than solid materials, e.g. the particles 120 of the expanded material. Hence, by interspersing the first deformation element 110 with air filled cavities, the overall heat conduction of the first deformation element 110 and thus the cushioning element 100 may be reduced so that the foot of a wearer, e.g., is better insulated against loss of body heat through the foot.

In general, some of the first voids 130 may form one or more cavities that trap air inside them, and some of the first voids 130 may form one or more channels throughout the first deformation element 110 that are permeable to air and/or liquids.

As already suggested above, whether the first voids 130 between the randomly arranged particles 120 predominantly form cavities that trap air inside them or predominantly form channels permeable to air and/or liquids may depend on the size, shape, material, density and so forth of the randomly arranged particles 120 and also on manufacturing parameters like temperature, pressure, packing density of the particles 120, etc. It may also depend on the pressure load on the first deformation element 110 or cushioning element 100.

For example, the forefoot region or the heel region of the first deformation element 110 will experience a strong compression during a gait cycle, e.g. during landing on the heel or push-off over the forefoot. Under such a pressure load, potential channels through the first deformation element 110 might be sealed. Also, during landing or push-off, the foot may be in close contact with the top surface of cushioning element 100. This condition might reduce the breathability. Sealing of the channels may, however, lead to the formation of additional cavities within the first deformation element 110, trapping air inside them, and thus increase the heat insulation of the cushioning element 100, which is particularly important during ground contact, because here a large amount of body heat might be lost.

After push-off of the foot, on the other hand, the randomly arranged particles 120 of the first deformation element 110 might re-expand, leading to a re-opening of the channels. Also, in the expanded state, some of the cavities present in the loaded state might open up and form channels through the first deformation element 110 that are permeable to air and/or liquids. Also the foot may not be in tight contact with the top surface of the cushioning element 100 anymore during such periods of the gait cycle. Hence, breathability might be increased during this phase whereas heat insulation might be reduced.

This interplay between the formation of channels and cavities within the first deformation element 110 depending on the state of compression may provide a preferred direction to an airflow through the first deformation element 110 and cushioning element 100, e.g. in the direction of the compression and re-expansion. For a cushioning element 100 arranged in the sole of a shoe, e.g., the compression and re-expansion in a direction from the foot to the ground during a gait cycle may guide and control airflow in that direction.

Figure 8A:
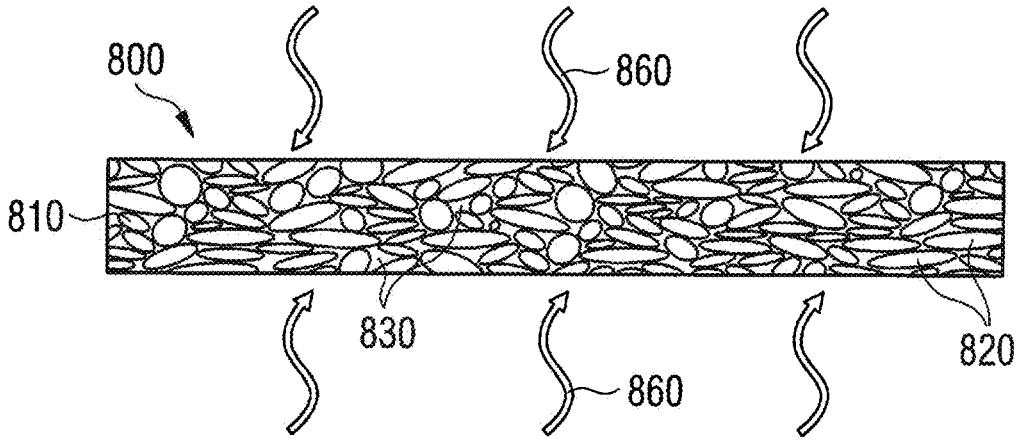
FIGS. 8*a-b* are schematic illustrations of the influence of the compression and re-expansion of the randomly arranged particles on an airflow through a first deformation element, according to certain embodiments of the present invention.
Figure 8B:
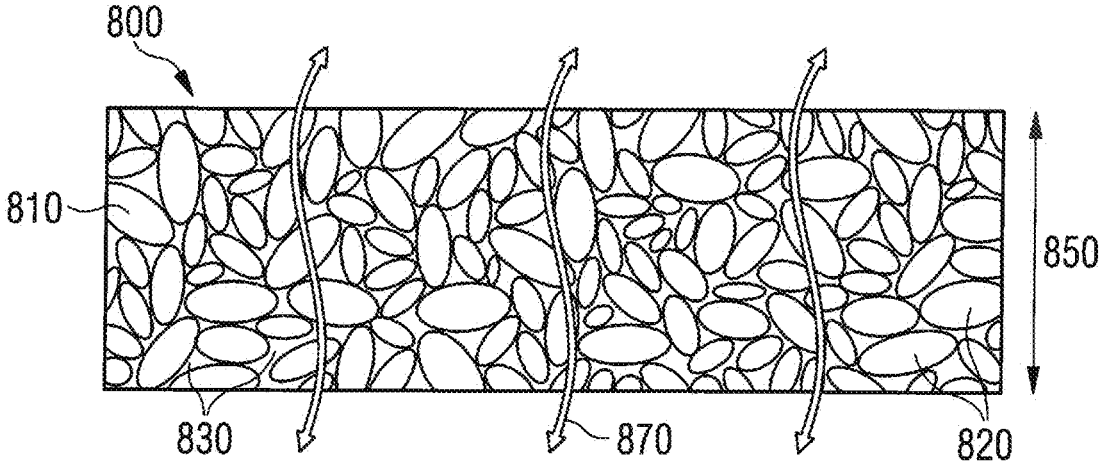

FIGS. 8*a-b* show an illustration of a directed airflow through a cushioning/deformation element discussed above. Shown is a cushioning element 800 with a first deformation element 810 that comprises randomly arranged particles 820 of an expanded material. There are also first voids 830 between and/or within the particles 820. FIG. 8*a* shows a compressed state wherein the compression is effected by a pressure acting in a vertical direction in the example shown here. FIG. 8*b* shows a re-expanded state of the first deformation element 810, wherein the (main) direction of re-expansion is indicated by the arrow 850.

It is clear to the skilled purpose that FIGS. 8*a-b* only serve illustrative purposes and the situation shown in these figures may deviate from the exact conditions found in an actual cushioning element. In particular, in an actual cushioning element, the particles 820 and voids 830 form a three-dimensional structure whereas here only two dimensions may be shown. This means, in particular, that in an actual cushioning element the potential channels formed by the voids 830 may also "wind through" the first deformation element 810, including in directions perpendicular to the image plane of FIGS. 8*a-b*.

In the compressed state, as shown in FIG. 8*a*, the individual particles 820 are compressed and deformed. Because of this deformation of the particles 820, the voids 830 in the first deformation element 810 may change their dimensions and arrangement. In particular, channels winding through the first deformation element 810 in the unloaded state might now be blocked by some of the deformed particles 820. On the other hand, additional cavities may, for example, be formed within the first deformation element 810 by sections of sealed or blocked channels. Hence, an airflow through the first deformation element might be reduced or blocked, as indicated by the arrows 860.

With re-expansion 850 of the first deformation element 810, cf. FIG. 8*b*, the particles 820 may also re-expand and return (more or less) to the form and shape they had before the compression. By this re-expansion, which may predominantly occur in the direction of the pressure that caused the deformation (i.e. a vertical direction in the case shown here, cf. 850), previously blocked channels might reopen and also previously present cavities might open up and connect to additional channels through the first deformation element 810. The re-opened and additional channels may herein predominantly "follow" the re-expansion 850 of the first deformation element 810, leading to a directed airflow through the first deformation element 810, as indicated by arrows 870. The re-expansion of the first deformation element 810 might even actively "suck in" air, further increasing the airflow 870.

Returning to the discussion of FIG. 1, a guided airflow as discussed above may, in particular, be employed in combination with the high energy return provided by a first deformation element 110 comprising randomly arranged particles 120 of an expanded material, e.g. eTPU. For example, in the forefoot region, the cushioning element 100 with the first deformation element 110 may provide high energy return to the foot of a wearer when pushing off over the toes. The re-expansion of the first deformation element 110 after push-off may also lead to a guided inflow of air into the forefoot region, leading to good ventilation and cooling of the foot. The re-expansion of the first deformation element 110 may even lead to a suction effect, sucking air into channels through the first deformation element 110, and may thus further facilitate ventilation and cooling of the foot. Such an efficient cooling may provide the foot of a wearer with additional "energy" and generally improve performance, well-being and endurance of an athlete.

A similar effect may also be provided, e.g., in the heel region of the cushioning element 100.

As a further option, it is also possible that the manufacture of the cushioning element 100 comprises the creation of one or more predefined channels (not shown) through the first deformation element 110 that are permeable to air and/or liquids. This design may allow further balance between the heat insulating properties vs. the breathability of the cushioning element 100. The predefined channel(s) may be created by corresponding protrusions or needles in a mold that is used for the manufacture of the cushioning element 100.

Figure 2:
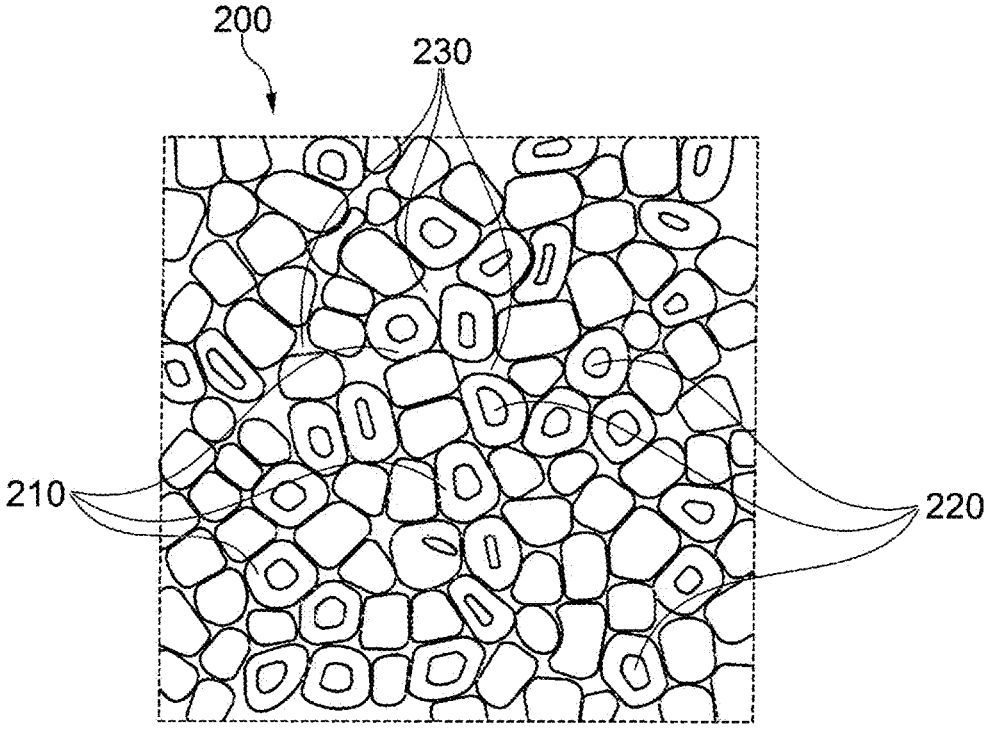
FIG. 2 is a top view of particles of an expanded material which have an oval cross-sectional profile, according to certain embodiments of the present invention.

FIG. 2 shows embodiments of particles 200 of an expanded material which have an oval cross-section. The particles have, in addition, a wall 210 and a continuous channel 220. Due to the oval shape of the particles 200 of the expanded material, voids 230 develop between the particles. The average size of these voids 230 may be dependent on the shape of the particles 200, in particular on the maximum achievable packing density of the particles 200 within a given mold, as explained above. So, for example, cuboid or cube-shaped particles may, as a rule, be packed more densely than spherical or oval-shaped particles 200. Furthermore, in a deformation element manufactured from the randomly arranged particles 200, due to the random arrangement of the particles 200, one or more channels permeable to air and/or liquids develop with a certain statistical probability, without requiring an alignment of the particles or the like, which significantly facilitates the manufacturing effort.

In the embodiments of the particles 200 shown in FIG. 2, the probability of a development of such channels is further increased by the tubular configuration of the particles 200 with the wall 210 and the continuous channel 220. For example, the channels permeable to air and/or liquids may extend along the channels 220 within the particles 200, along the voids 230 between the particles 200, and along a combination of the channels 220 within and the voids 230 between the particles 200.

The average size of the voids 230 as well as the probability of developing channels permeable to air and/or liquids in the finished deformation element depend furthermore on the pressure with which the particles are filled into a mold used for manufacture and/or on the parameters of the heating and/or pressurizing and/or steaming process to which the particles may be subjected in the mold. In addition, it is possible that the particles 200 have one or more different colors, which influences the optical appearance of the finished deformation element or cushioning element, respectively. In certain embodiments, the particles 200 are made of expanded thermoplastic urethane and are colored with a color comprising liquid thermoplastic urethane, which may lead to a very durable coloring of the particles and hence of the deformation element or cushioning element, respectively.

Figure 3:
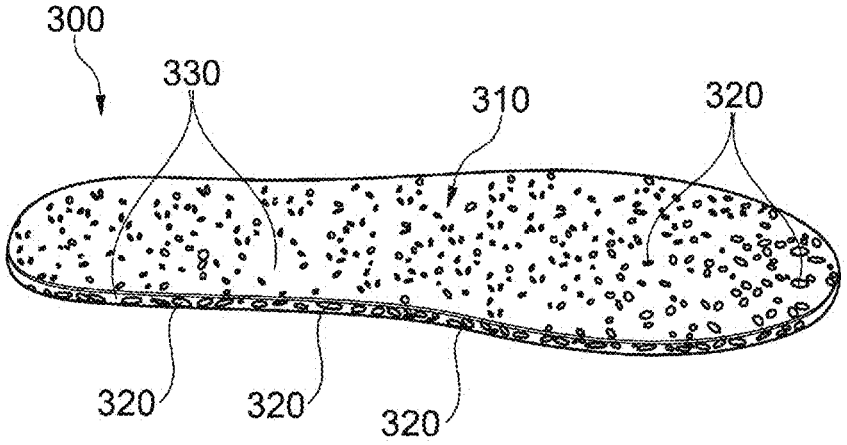
FIG. 3 is a perspective view of a cushioning element provided as midsole, wherein a solidified liquid resides in the first voids, according to certain embodiments of the present invention.

FIG. 3 shows further embodiments of a cushioning element 300 configured as a midsole and comprising a deformation element 310, according to certain embodiments of the present invention. The deformation element 310 comprises a number of randomly arranged particles 320 of an expanded material, whereby first voids 330 are present between the particles 320. In the embodiments shown in FIG. 3, however, a solidified liquid resides between the voids 330. Said solidified liquid 330 may, for instance, be a solidified liquid 330 comprising one or more of the following materials: thermoplastic urethane, ethylene-vinyl-acetate or other materials that are compatible with the respective expanded material of the particles 320. Furthermore, in certain embodiments, the solidified liquid 330 may serve as transport fluid for filling the particles 320 of the expanded material into a mold used for manufacturing the cushioning element 300, whereby the transport fluid solidifies during the manufacturing process, for example, during a heating and/or pressurizing and/or steaming process. In further embodiments, the particles 320 introduced into a mold are continuously coated with the liquid 330 which solidifies gradually during this process.

The solidified liquid increases the stability, elasticity and/or tensile strength of the deformation element 310 and thus allows the manufacture of a very thin cushioning element 300, according to certain embodiments of the invention, which may reduce the weight of such a cushioning element 300. Furthermore, the low thickness of such a cushioning element 300 allows the use of the cushioning element 300 in regions of sports apparel where too great a thickness would lead to a significant impediment of the wearer, for example in the region of the elbow or the knee in case of outdoor and/or winter sports clothing, or for shin-guards or the like.

By means of an appropriate combination of the materials of the particles 320 and the solidified liquid 330, as well as a variation of the respective percentages in the deformation element 310, according to the present invention, deformation elements 310 with a plurality of different properties such as thickness, elasticity, tensile strength, compressibility, weight, and the like may be manufactured.

Figure 4:
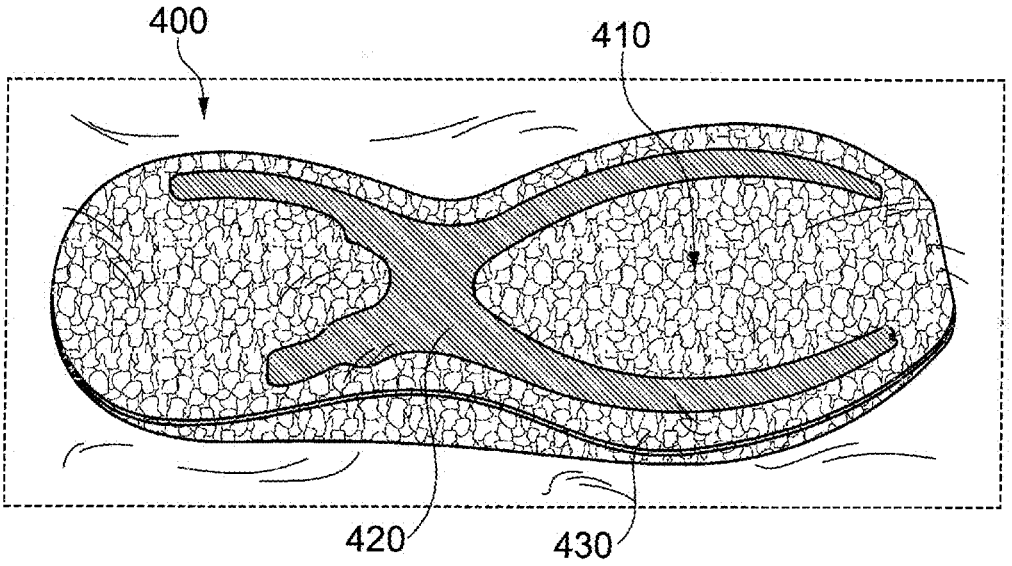
FIG. 4 is a top view of a cushioning element provided as midsole with a first reinforcing element and a second foil-like reinforcing element, according to certain embodiments of the present invention.

FIG. 4 shows further embodiments according to certain embodiments of the invention. FIG. 4 shows a cushioning element 410 configured as a midsole. The cushioning element 400 comprises a deformation element 410, which comprises a number of randomly arranged particles of an expanded material, with first voids being present within the particles and/or between the particles. The cushioning element 400 further comprises a first reinforcing element 420, which preferably is a textile and/or fiber-like reinforcing element 420. The reinforcing element 420 serves to increase the stability of the deformation element 410 in selected regions, in some embodiments shown in FIG. 4 in the region of the midfoot. The use of a textile and/or fiber-like reinforcing element 420 in combination with a deformation element 410 allows, according to one or more aspects of the present invention, the manufacture of a very light cushioning element 400 that nevertheless has the necessary stability. Such embodiments of a cushioning element 400 may be used in the construction of shoe soles. In further embodiments, the reinforcing element 420 may also be another element that increases the stability of the deformation element 420 or a decorative element or the like.

According to further embodiments of the invention, the cushioning element 400 shown in FIG. 4 furthermore comprises a foil-like reinforcing element 430. In certain embodiments, this is a foil comprising thermoplastic urethane. When combined with a deformation element 410, which comprises randomly arranged particles that comprise expanded thermoplastic urethane, such a foil 430 may form a chemical bond with the expanded particles that is extremely durable and resistant and, as such, does not require an additional use of adhesives. As a result, the manufacture of such cushioning elements 400 may be easier, more cost-effective and more environment-friendly.

The use of a foil-like reinforcing element 430 may increase the (form) stability of the cushioning element 400, while also protecting the cushioning element 400 against external influences, such as abrasion, moisture, UV light, or the like. In certain embodiments, the first reinforcing element 420 and/or the foil-like reinforcing element 430 further comprise at least one opening. The at least one opening may be arranged such that air and/or liquids flowing through one or more of the channels permeable to air and/or liquids may pass in at least one direction through the at least one opening. As a result, manufacture of breathable cushioning elements 400 is facilitated, while also using the advantages of additional reinforcing elements 420, 430 described above to protect against moisture from the outside. Thereby, in certain embodiments, the foil-like reinforcing element 430 is designed as a membrane that is permeable to air in both directions for breathability, but is permeable to liquids in one direction only, preferably in the direction from the foot outwards, so that no moisture from the outside may penetrate from the outside into the shoe and to the foot of the wearer.

Figure 5:
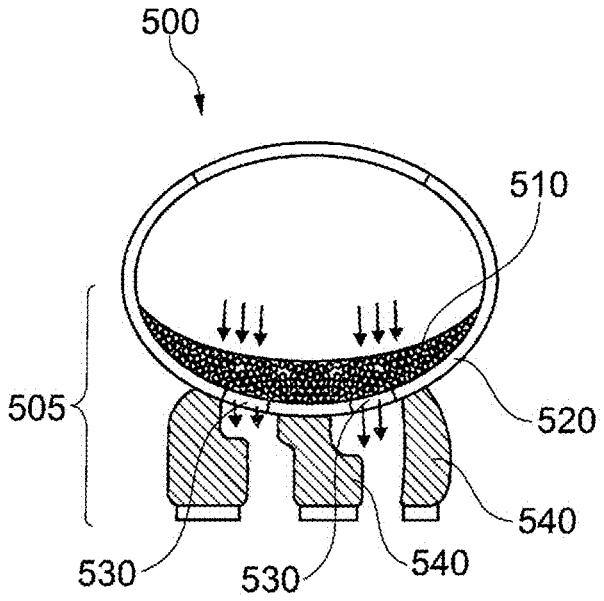
FIG. 5 is a cross-section of a shoe with a cushioning element configured as a sole, and a reinforcing element which comprises a series of openings which are permeable to air and liquids, according to certain embodiments of the present invention.

FIG. 5 shows a schematic cross-section of a shoe 500, according to other embodiments of the present invention. The shoe 500 comprises a cushioning element designed as a midsole 505, which cushioning element comprises a deformation element 510 which may comprise randomly arranged particles of an expanded material. Here, voids are present within the particles and/or between the particles. Preferably, the voids, as described above, develop one or more channels permeable to air and/or liquids through the deformation element 510. In certain embodiments, the materials and the manufacturing parameters are selected such that the channels, as described above, are permeable to air, but not to liquids. This design enables the manufacture of a shoe 500 which, though being breathable, protects the foot of the wearer against moisture from the outside.

The cushioning element 505 shown in FIG. 5 further comprises a reinforcing element 520 which is configured as a cage element in the presented embodiments and which, for example, encompasses a three-dimensional shoe upper. In order to avoid negative influences on the breathability of the shoe, the reinforcing element 520 preferably comprises a succession of openings 530 arranged such that air and/or fluid flowing through the channels in the deformation element 510 may flow, in at least one direction, through the at least one opening 530 in the reinforcing element 520, e.g. from the inside to the outside. Furthermore, the cushioning element 505 preferably comprises a series of outer sole elements 540, which may fulfill a number of functions. As a result, the outer sole elements 540 may additionally protect the foot of the wearer against moisture and/or influence the cushioning properties of the sole 505 of the shoe 500 in a favorable manner and/or further increase the ground contact of the shoe 500 and so forth.

Figure 6:
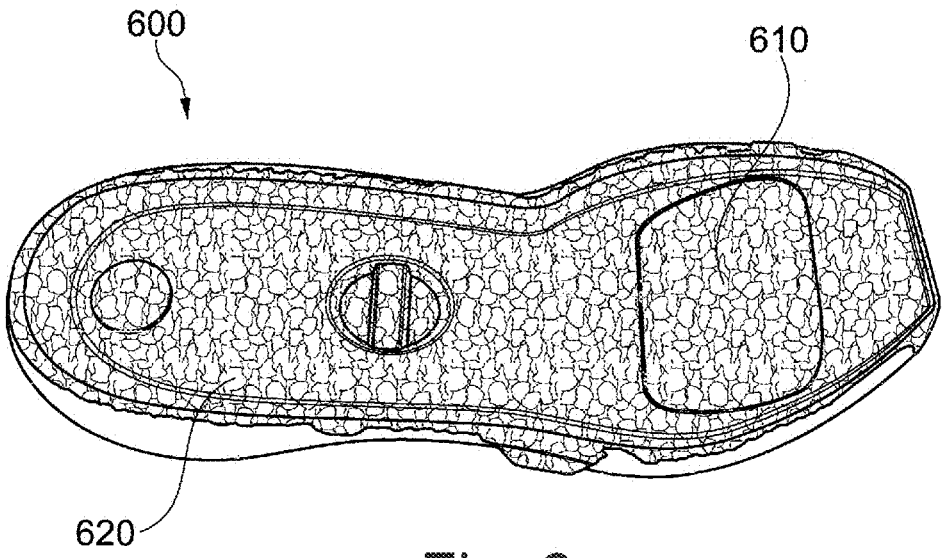
FIG. 6 is a top view of a cushioning element provided as a midsole and with a deformation element which constitutes a first partial region of the cushioning element, according to certain embodiments of the present invention.
Figure 7:
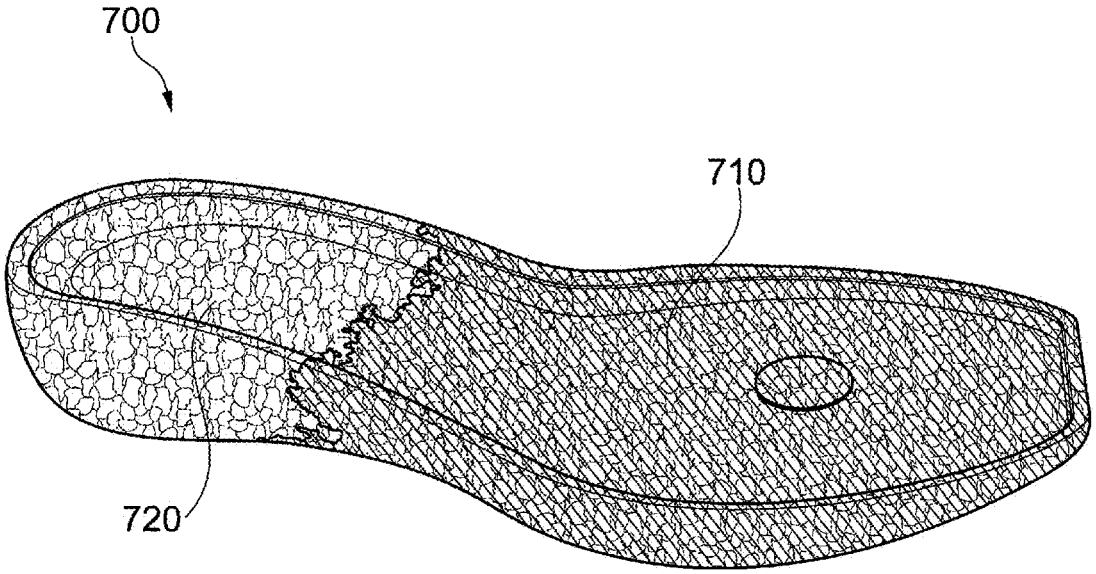
FIG. 7 is a perspective view of a cushioning element configured as a midsole, which comprises a first deformation element and a second deformation element, according to certain embodiments of the present invention.

FIG. 6 and FIG. 7 show further embodiments of cushioning elements 600, 700 provided as midsoles, each comprising a first deformation element 610, 710 which takes up a first partial region of the cushioning element 600, 700, and a second deformation element 620, 720, which takes up a second partial region of the cushioning element 600, 700. The different deformation elements 610, 710, 620, 720 each comprise randomly arranged particles of an expanded material, with voids being present within the particles and/or between the particles of the deformation elements 610, 710, 620, 720. For the different deformation elements 610, 710, 620, 720, particles of the same expanded material or of different materials may be used. Furthermore, the particles may have the same cross-sectional profile or different shapes. The particles may also have different sizes, densities, colors etc. before filling into the molds (not shown), which are used for the manufacture of the cushioning elements 600, 700. According to certain embodiments of the invention, the particles for the first deformation element 610, 710 and the second deformation element 620, 720, as well as the manufacturing parameters, are selected such that the voids in the first deformation element 610 or 710, respectively, show a different size on average than the voids in the second deformation element 620 or 720.

For example, the particles and the manufacturing parameters (e.g. pressure, duration and/or temperature of a heating and/or pressurizing and/or steaming process) may be selected such that the voids in the second deformation element 620 or 720, respectively, are smaller on average than the voids in the first deformation element 610 or 710, respectively. Therefore, by combining different deformation elements, properties such as, elasticity, breathability, permeability to liquids, heat insulation, density, thickness, weight etc. of the cushioning element may be selectively influenced in individual partial regions, which increases the constructional freedom to a considerable extent. In further embodiments, the cushioning element comprises an even higher number (three or more) of different deformation elements which each take up a partial region of the cushioning element. Here, all deformation elements may comprise different properties (e.g., size of the voids), or several deformation elements may have similar properties or comprise the same properties.

As one example, it is conceivable that the randomly arranged particles in the first deformation element 610, 710 and the manufacturing parameters are chosen such that the first voids between and/or within the randomly arranged particles of the first deformation element 610, 710 predominantly form channels throughout the first deformation element 610, 710 that are permeable to air and/or liquids, thus creating good breathability in this region. The randomly arranged particles in the second deformation element 620, 720 and the manufacturing parameters may be chosen such that the second voids between and/or within the randomly arranged particles in the second deformation element 620, 720 predominantly form cavities which trap air inside them, thus creating good heat insulation in this region. The opposite situation is also possible.

Figure 9A:
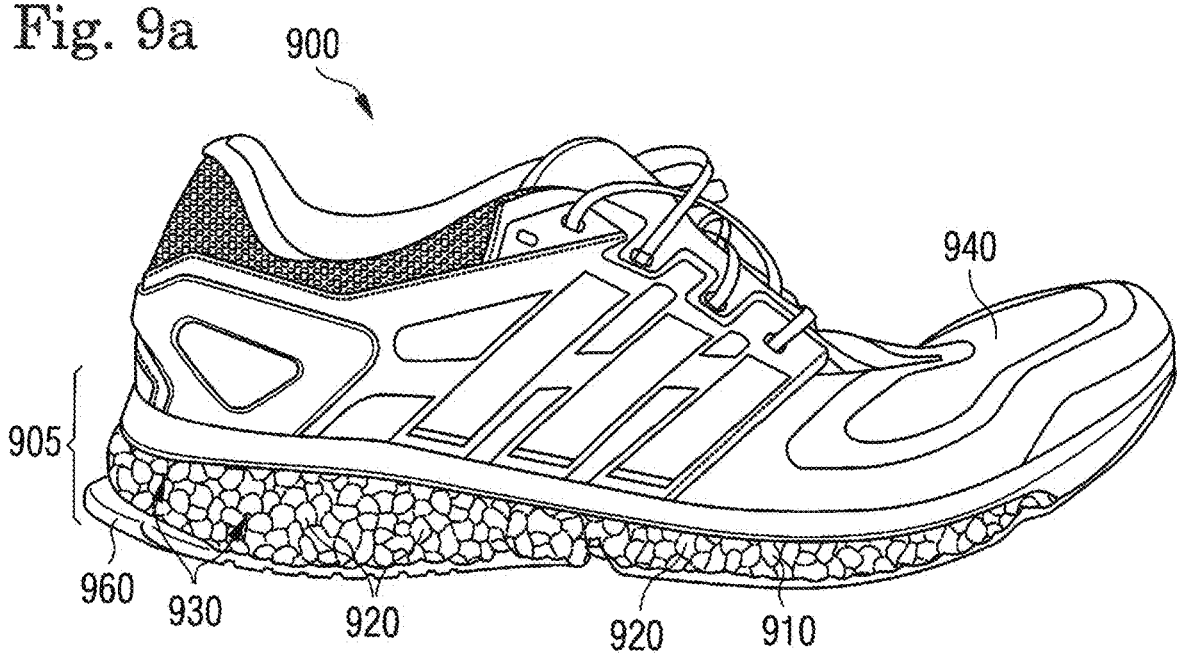
FIG. 9*a* is a lateral side view of a shoe comprising a cushioning element, according to certain embodiments of the present invention.
Figure 9B:
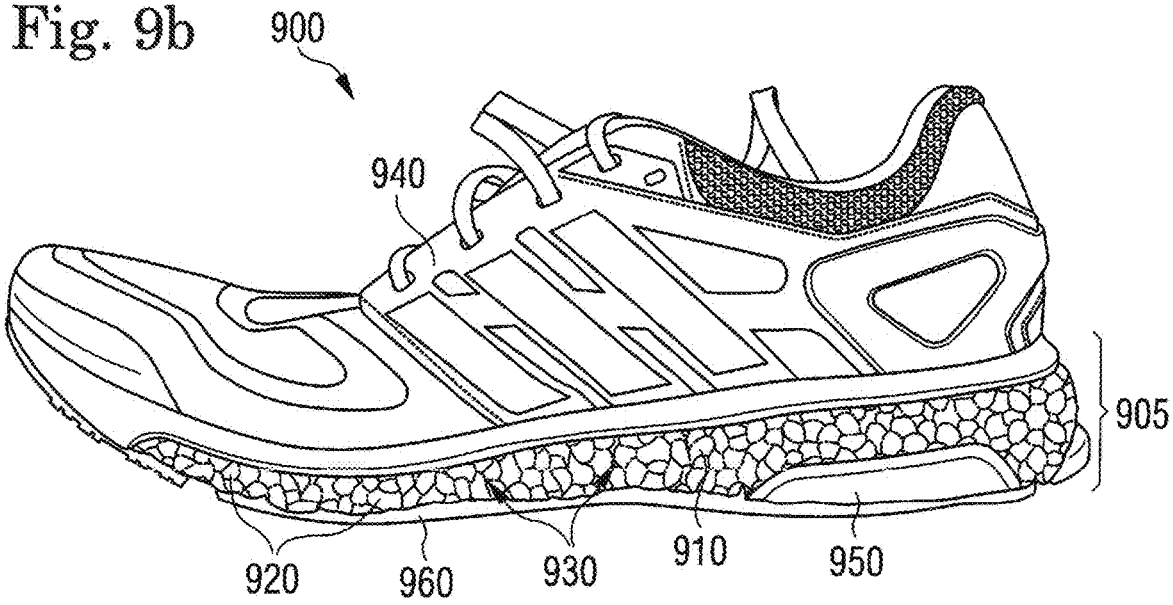
FIG. 9*b* is a medial side view of the shoe of FIG. 9*a*.
Figure 9C:
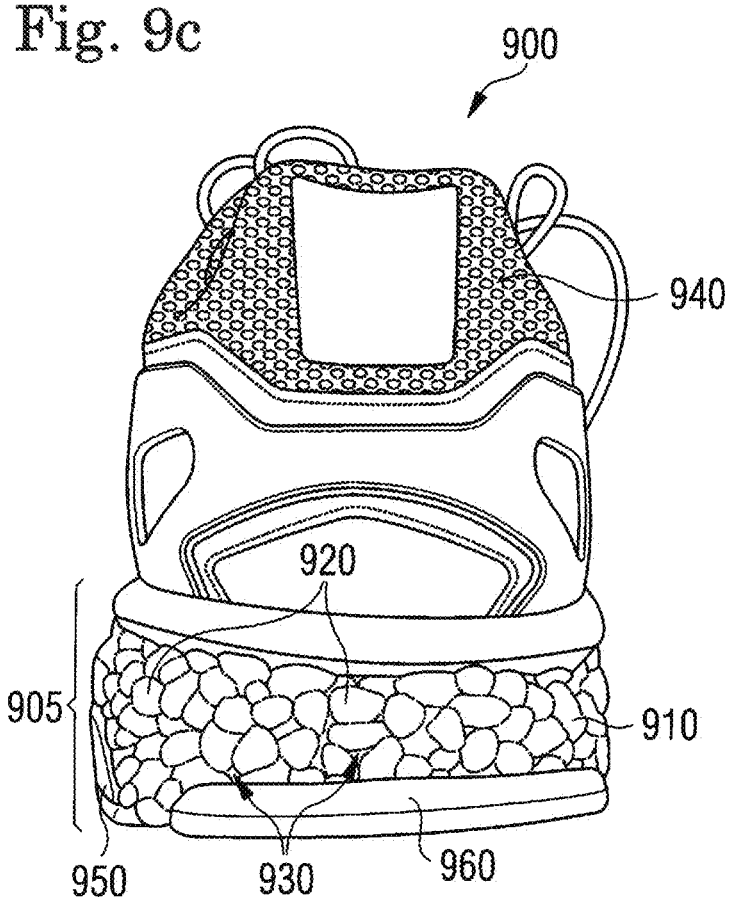
FIG. 9*c* is a rear view of the shoe of FIG. 9*a*.
Figure 9D:
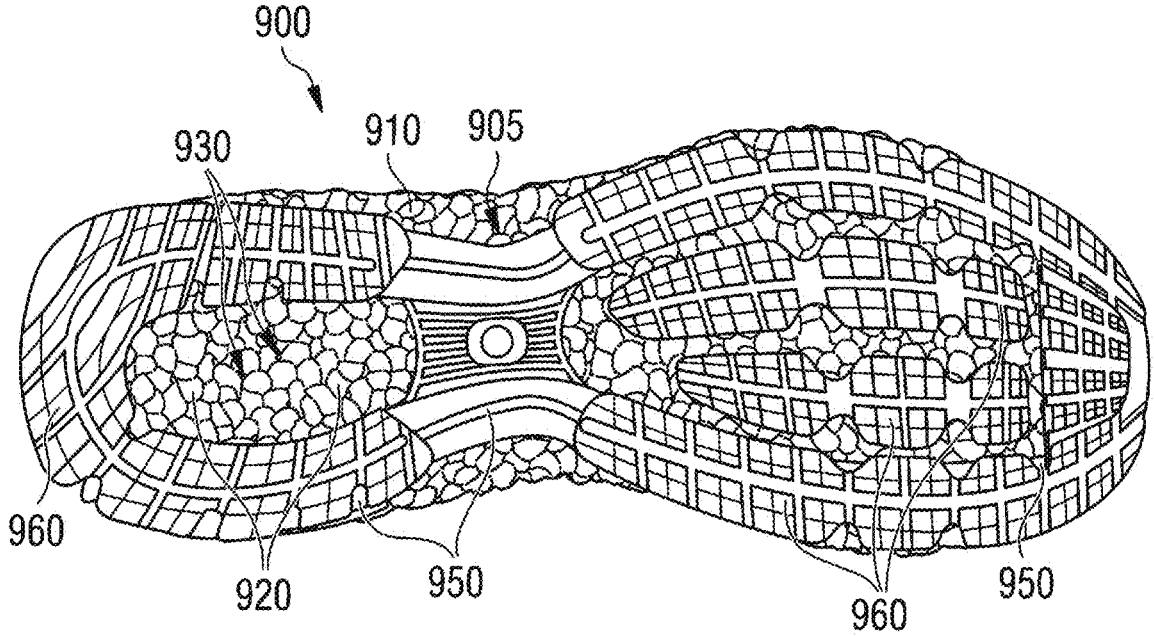
FIG. 9*d* is a bottom view of the shoe of FIG. 9*a*.
Figure 9E:
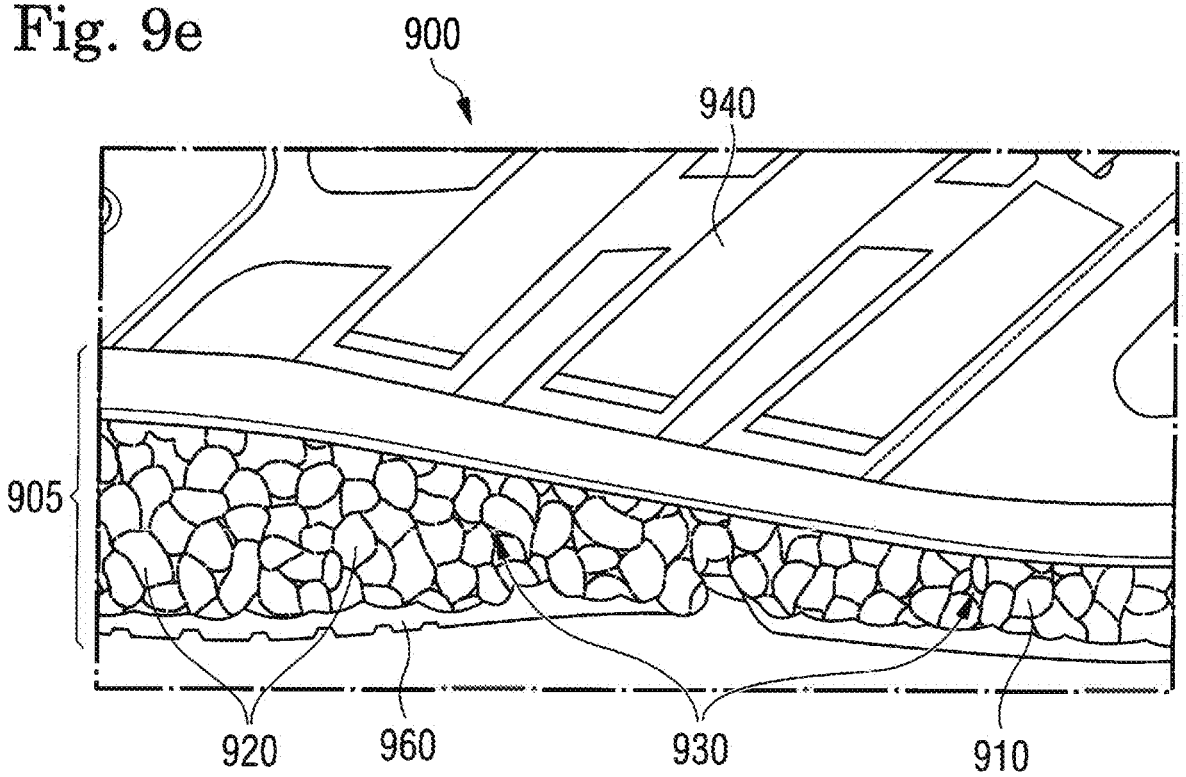
FIGS. 9*e* and 9*f* are enlarged pictures of the cushioning element 905 of the shoe of FIG. 9*a*.
Figure 9F:
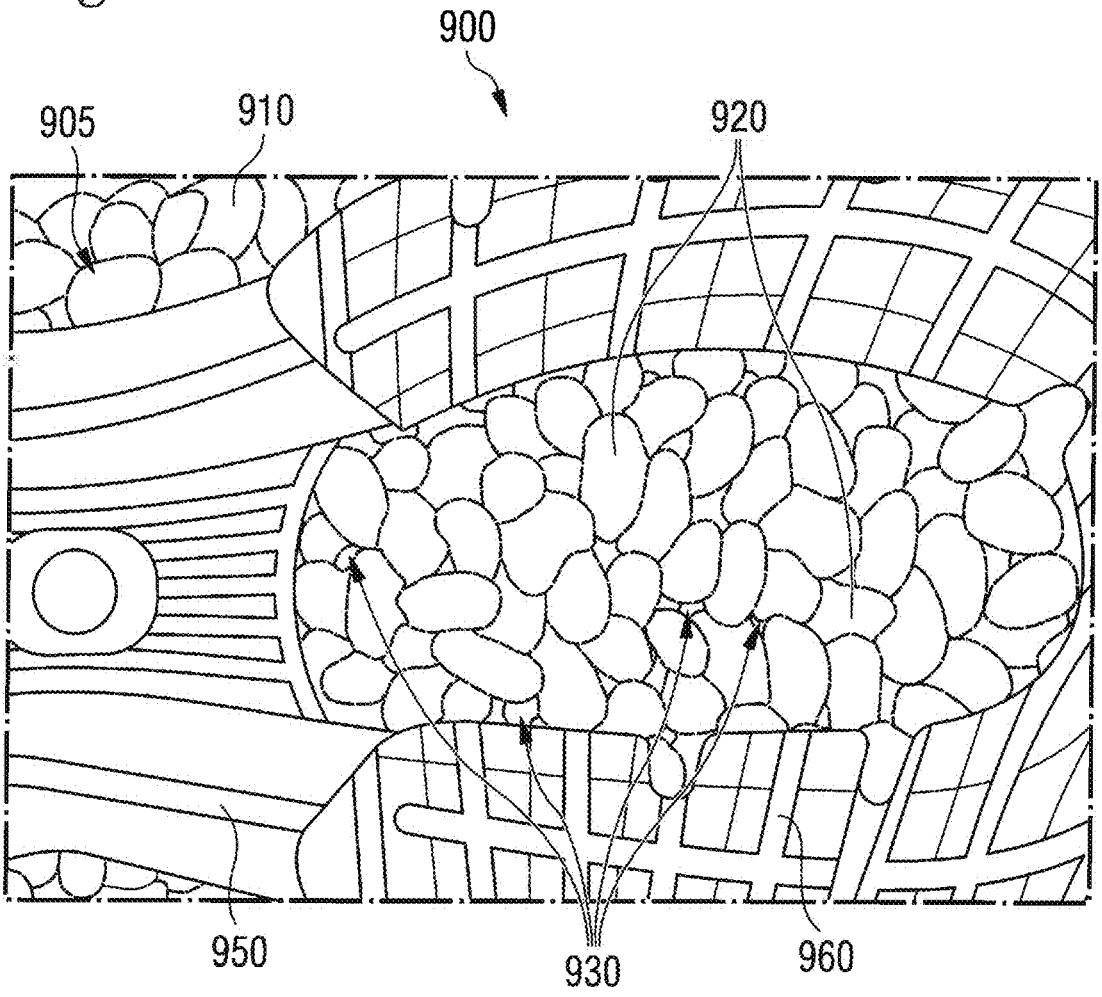

Finally, FIGS. 9*a-f* show embodiments of a shoe 900 comprising embodiments of a cushioning element 905. FIG. 9*a* shows the lateral side of the shoe 900, and FIG. 9*b* shows the medial side. FIG. 9*c* shows the back of the shoe 900, and FIG. 9*d* shows the bottom side. Finally, FIGS. 9*e* and 9*f* show enlarged pictures of the cushioning element 905 of the shoe 900.

The cushioning element 905 comprises a first deformation element 910, comprising randomly arranged particles 920 of an expanded material with first voids 930 between the particles 920. All explanations and considerations put forth above with regard to the embodiments of cushioning elements 100, 300, 400, 505, 600, 700, 800 and first deformation elements 110, 310, 410, 510, 610, 710, 810 also apply here.

Furthermore, emphasis is once again put on the fact that by at least partially fusing the particle surfaces, e.g. by means of a steaming process or some other process, the resulting bond is strong enough so that the particles 920 are not "picked off" during use of the shoe 900.

The cushioning element further comprises a reinforcing element 950 and an outsole layer 960. Both reinforcing element 950 and outsole layer 960 may comprise several subcomponents that may or may not form one integral piece. In these embodiments shown here, the reinforcing element 950 comprises a pronation support in the medial heel region and a torsion bar in the region of the arch of the foot. The outsole layer 960 comprises several individual subcomponents arranged along the rim of the sole and in the forefoot region.

Finally, the shoe 900 comprises an upper 940.

The shoe 900 with cushioning element 905 may, in particular, provide a high energy return to the foot of a wearer, combined with good heat insulation properties during ground contact and high ventilation, potentially with directed airflow, during other times of a gait cycle, thus helping to increase wearing comfort, endurance, performance and general well-being of an athlete.

In the following, further examples are described to facilitate the understanding of the invention:

1. Cushioning element for sports apparel, comprising:

a. a first deformation element comprising a plurality of randomly arranged particles of an expanded material;

b. wherein there are first voids within the particles and/or between the particles.

2. Cushioning element according to example 1, wherein the particles of the expanded material comprise one or more of the following materials: expanded ethylene-vinyl-acetate, expanded thermoplastic urethane, expanded polypropylene, expanded polyamide; expanded polyether block amide, expanded polyoxymethylene, expanded polystyrene; expanded polyethylene, expanded polyoxyethylene, expanded ethylene propylene diene monomer.

3. Cushioning element according to example 1 or 2, wherein the particles of the expanded material comprise one or more of the following cross-sectional profiles: ring-shaped, oval, square, polygonal, round, rectangular, star-shaped.

4. Cushioning element according to one of the preceding examples 1-3, wherein the first deformation element is manufactured by inserting the particles of the expanded material into a mold and, after the inserting into the mold, subjecting the particles of the expanded material to a heating and/or a pressurization and/or a steaming process.

5. Cushioning element according to example 4, wherein, before inserting into the mold, the particles comprise a density of 10-150 g/l, preferably 10-100 g/l and particularly preferably 10-50 g/l.

6. Cushioning element according to one of the preceding examples 1-5, wherein the first deformation element is manufactured by intermixing the particles of the expanded material with a further material which is subsequently removed or remains at least partially within the first voids of the first deformation element.

7. Cushioning element according to example 6, wherein a solidified liquid resides in the first voids of the first deformation element.

8. Cushioning element according to one of the preceding examples 1-7, wherein the first voids form one or more cavities in which air is trapped.

9. Cushioning element according to one of the preceding examples 1-8, wherein the first voids form one or more channels through the first deformation element that are permeable to air and/or liquids.

10. Cushioning element according to one of the preceding examples 1-9, further comprising a reinforcing element, in particular a textile reinforcing element and/or a foil-like reinforcing element and/or a fiber-like reinforcing element.

11. Cushioning element according to example 10, wherein the reinforcing element is provided as a foil comprising thermoplastic urethane.

12. Cushioning element according to example 10 or 11 in combination with example 9, wherein the reinforcing element comprises at least one opening which is arranged in such a way that air and/or a liquid passing through the one or more channels in the first deformation element can pass in at least one direction through the at least one opening in the reinforcing element.

13. Cushioning element according to one of the preceding examples 1-12, wherein the first deformation element takes up a first partial region of the cushioning element and wherein the cushioning element further comprises a second deformation element.

14. Cushioning element according to example 13, wherein the second deformation element comprises a plurality of randomly arranged particles of an expanded material, wherein there are second voids within the particles and/or between the particles of the second deformation element, and wherein the second voids are smaller on average than the first voids of the first deformation element.

15. Cushioning element according to one of the preceding examples 1-14, wherein the cushioning element is provided as at least a part of a sole of a shoe, in particular as at least a part of a midsole.

16. Cushioning element according to one of the examples 1-14, wherein the cushioning element is provided as at least a part of an insole of a shoe.

17. Shoe comprising at least one cushioning element according to example 15 and/or example 16.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A shoe comprising at least one cushioning element comprising:

a) a deformation element comprising a plurality of randomly arranged particles of an expanded material, wherein the particles are at least partially fused at their surfaces and wherein there are voids between the particles;

b) a reinforcing element, wherein the at least one reinforcing element increases the stability of the deformation element; and c) an outsole;

d) wherein the reinforcing element surrounds at least a portion of the plurality of randomly arranged particles on a ground facing surface of the shoe sole and e) wherein the outsole and/or the deformation element are configured to contact the ground when the shoe is worn.

2. The shoe sole according to claim 1, wherein the plurality of randomly arranged particles comprises a density of 10 to 150 g/l.

3. The shoe sole according to claim 1, wherein the reinforcing element is a foil comprising thermoplastic urethane.

4. The shoe sole according to claim 3, wherein the foil is chemically bonded to at least a portion of the plurality of randomly arranged particles.

5. The shoe sole according to claim 1, wherein the reinforcing element is a textile.

6. The shoe sole according to claim 1, wherein the reinforcing element has at least one opening.

7. The shoe sole according to claim 1, wherein the reinforcing element is a membrane.

8. The shoe sole according to claim 1, wherein the reinforcing element comprises an opening arranged to make the reinforcing element permeable to air in both directions.

9. The shoe sole according to claim 1, wherein the reinforcing element comprises an opening arranged to make the reinforcing element permeable to liquid in one direction.

10. The shoe sole according to claim 1, wherein the reinforcing element is cage-shaped.

11. The shoe sole according to claim 1, wherein the voids form one or more cavities in which air is trapped.

12. The shoe sole according to claim 1, wherein the voids form one or more channels through the deformation element that are permeable to air and/or liquids.

13. The shoe sole according to claim 1, wherein the expanded material comprises at least one of expanded ethylene-vinyl-acetate (eEVA), expanded thermoplastic urethane (eTPU), expanded polypropylene (ePP), expanded polyamide (ePA), expanded polyether block amid (ePEBA), expanded polyoxymethylene (ePOM), expanded polystyrene (ePS), expanded polyethylene (ePE), expanded polyethylene (ePOE), expanded polyoxyethylene (ePOE), and expanded ethylene-propylene-diene monomer (eEPDM).

14. The shoe sole according to claim 1, wherein the particles have a ring-shaped, oval, square, polygonal, round, rectangular, or star-shaped cross-section.

15. A shoe sole comprising a cushioning element comprising:

a) a deformation element;

b) a reinforcing element; and c) an outsole, wherein the deformation element comprises a plurality of randomly arranged particles of an expanded material having voids therebetween, wherein the particles are at least partially fused at their surfaces, wherein the deformation element is at least partially surrounded by a reinforcing element on a ground facing surface of the shoe sole; and wherein the plurality of randomly arranged particles of an expanded material comprise expanded thermoplastic urethane (eTPU), expanded polypropylene (ePP), expanded polyamide (ePA), expanded polyether block amid (ePEBA), expanded polyoxymethylene (ePOM), expanded polystyrene (ePS), expanded polyethylene (ePE), expanded polyethylene (ePOE), expanded polyoxyethylene (ePOE), and expanded ethylene-propylene-diene monomer (eEPDM).

16. The shoe sole according to claim 15, wherein the plurality of randomly arranged particles of an expanded material comprise expanded thermoplastic polyurethane particles.

17. The shoe sole according to claim 15, wherein the voids form one or more channels through the deformation element that are permeable to air, liquids, or both air and liquids.

18. The shoe sole according to claim 15, wherein the voids form one or more cavities in which air is trapped.

* * * * *